US009519234B2

(12) United States Patent
Kishida et al.

(10) Patent No.: US 9,519,234 B2
(45) Date of Patent: Dec. 13, 2016

(54) CARRIER, TWO-COMPONENT DEVELOPER, SUPPLEMENTAL DEVELOPER, IMAGE FORMING METHOD, PROCESS CARTRIDGE AND IMAGE FORMING APPARATUS

(71) Applicants: Hiroyuki Kishida, Shizuoka (JP); Shigenori Yaguchi, Shizuoka (JP); Hiroshi Tohmatsu, Shizuoka (JP); Koichi Sakata, Shizuoka (JP); Hitoshi Iwatsuki, Shizuoka (JP); Toyoaki Tano, Shizuoka (JP)

(72) Inventors: Hiroyuki Kishida, Shizuoka (JP); Shigenori Yaguchi, Shizuoka (JP); Hiroshi Tohmatsu, Shizuoka (JP); Koichi Sakata, Shizuoka (JP); Hitoshi Iwatsuki, Shizuoka (JP); Toyoaki Tano, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/410,711

(22) PCT Filed: Jun. 26, 2013

(86) PCT No.: PCT/JP2013/068193

§ 371 (c)(1),
(2) Date: Dec. 23, 2014

(87) PCT Pub. No.: WO2014/003200

PCT Pub. Date: Jan. 3, 2014

(65) Prior Publication Data

US 2015/0153665 A1 Jun. 4, 2015

(30) Foreign Application Priority Data

Jun. 27, 2012 (JP) ..... 2012-143841
Mar. 8, 2013 (JP) ..... 2013-046257

(51) Int. Cl.
*G03G 9/00* (2006.01)
*G03G 9/083* (2006.01)
(Continued)

(52) U.S. Cl.
CPC ..... *G03G 9/0839* (2013.01); *G03G 9/1075* (2013.01); *G03G 9/1139* (2013.01); *G03G 21/18* (2013.01); *H01F 1/01* (2013.01)

(58) Field of Classification Search
CPC .... G03G 9/0839; G03G 21/18; G03G 9/1075; G03G 9/1139; H01F 1/01
(Continued)

(56) References Cited

U.S. PATENT DOCUMENTS 6,235,443 B1 5/2001 Kayamoto et al.
6,465,144 B1 * 10/2002 Hashimoto ..... G03G 9/0819 399/297
(Continued)

FOREIGN PATENT DOCUMENTS

EP 1 030 224 A1 8/2000
JP 55-127569 10/1980
(Continued)

OTHER PUBLICATIONS

Machine Translation of JP 2010 072114.*
(Continued)

*Primary Examiner* — Thorl Chea
(74) *Attorney, Agent, or Firm* — Oblon, McClelland, Maier & Neustadt, L.L.P.

(57) ABSTRACT

There is provided a carrier including magnetic core particles; and a coating layer on a surface of each of the magnetic core particles, wherein the coating layer contains electroconductive particles; wherein the electroconductive particles are electroconductive particles in which white inorganic pigments are coated with phosphorus-doped tin or
(Continued)

tungsten-doped tin; and wherein a dope ratio of phosphorus or tungsten to tin in the phosphorus-doped tin or tungsten-doped tin is 0.010 to 0.100.

13 Claims, 2 Drawing Sheets

(51) Int. Cl.
*G03G 9/107* (2006.01)
*G03G 9/113* (2006.01)
*G03G 21/18* (2006.01)
*H01F 1/01* (2006.01)

(58) Field of Classification Search
USPC ..... 430/111.1, 106.2
See application file for complete search history.

(56) References Cited

U.S. PATENT DOCUMENTS

| | | | |
|---|---|---|---|
| 8,916,325 | B2 | 12/2014 | Yaguchi et al. |
| 2010/0068645 | A1 | 3/2010 | Iwatsuki et al. |
| 2011/0081608 | A1 | 4/2011 | Yaguchi et al. |
| 2011/0091802 | A1 | 4/2011 | Takahashi et al. |
| 2013/0065175 | A1 | 3/2013 | Sakata et al. |
| 2014/0023966 | A1 | 1/2014 | Sawada et al. |
| 2014/0072910 | A1 | 3/2014 | Iwatsuki et al. |
| 2014/0248557 | A1 | 9/2014 | Yaguchi et al. |

FOREIGN PATENT DOCUMENTS

| | | |
|---|---|---|
| JP | 55-157751 | 12/1980 |
| JP | 56-140358 | 11/1981 |
| JP | 57-096355 | 6/1982 |
| JP | 57-096356 | 6/1982 |
| JP | 58-207054 | 12/1983 |
| JP | 61-110161 | 5/1986 |
| JP | 62-273576 | 11/1987 |
| JP | 07-140723 | 6/1995 |
| JP | 08-179570 | 7/1996 |
| JP | 08-286429 | 11/1996 |
| JP | 2959927 | 7/1999 |
| JP | 2000-242044 | 9/2000 |
| JP | 2003-280257 | 10/2003 |
| JP | 2006-079022 | 3/2006 |
| JP | 2008-262155 | 10/2008 |
| JP | 4307352 | 5/2009 |
| JP | 2009-186769 | 8/2009 |
| JP | 2009-251483 | 10/2009 |
| JP | 2010-072114 | 4/2010 |
| JP | 2010-117519 | 5/2010 |
| JP | 2010-122411 | 6/2010 |
| JP | 2010-217629 A | 9/2010 |
| JP | 2010-230836 | 10/2010 |
| JP | 4712288 | 4/2011 |
| JP | 4778139 | 7/2011 |
| JP | 2012-047917 | 3/2012 |
| JP | 2012-058448 | 3/2012 |
| JP | 2013-109197 | 6/2013 |

OTHER PUBLICATIONS

International Search Report Issued Aug. 20, 2013 in PCT/JP2013/068193 Filed Jun. 26, 2013.
Extended European Search Report issued May 20, 2015 in Patent Application No. 13810608.3.

* cited by examiner

CARRIER, TWO-COMPONENT DEVELOPER, SUPPLEMENTAL DEVELOPER, IMAGE FORMING METHOD, PROCESS CARTRIDGE AND IMAGE FORMING APPARATUS

TECHNICAL FIELD

The present invention relates to an electrostatic latent image developing carrier used for an electrophotographic method or an electrostatic recording method, and a two-component developer, a supplemental developer, an image forming method, a process cartridge and an image forming apparatus using the carrier.

BACKGROUND ART

In electrophotographic image formation, an electrostatic latent image is formed on an electrostatic latent image bearing member such as a photoconductive material, and formed into a toner image with a charged toner. The toner image is then transferred onto and fixed on a recording medium to thereby form output image. In the field of electrophotography, full-color copiers and printers have been rapidly brought to the mainstream in place of monochrome copiers and printers recently. Therefore, a market of the full-color copiers and printers has tended to expand.

In full-color image formations, generally, three color toners of yellow, magenta and cyan, or four color toners of black as well as yellow, magenta, and cyan are superimposed to thereby reproduce all colors. Thus, in order to obtain a sharp full-color image being excellent in color-reproducibility, it is necessary to smooth the surface of a fixed toner image so as to reduce light scattering. For this reason, in conventional full-color copiers, images having a middle-glossiness to a high-glossiness of 10% to 50% have been often formed.

Generally, as a method of fixing a dry-toner image on a recording medium, the contact-heat fixing method has been often employed in which a roller or belt having a smooth surface is allowed to press-contact with a toner while heating the roller or belt. This method has advantages in that it exhibits high-thermal efficiency, enables high-speed fixing and imparts glossiness and transparency to color toner images. On the other hand, this method inconveniently causes a so-called offset phenomenon in which a part of a toner image adheres to the surface of a fixing roller and then transferred onto another image, because the surface of a heat-fixing member is made in contact with a molten toner under pressure and then they are separated from each other.

In order to prevent the offset phenomenon, there has been adopted a method of forming a surface layer of a fixing roller with use of a material being excellent in releasing property such as a silicone rubber or a fluoro-resin, and further applying a toner adhesion preventing oil such as a silicone oil onto the surface layer of the fixing roller. This method is extremely effective in preventing toner-offset. However, this method requires additionally providing a device for supplying the oil, leading to an increase in size of the fixing device.

Therefore, in monochrome image formations, there has been often adopted an oil-less system in which a toner, which has a high viscoelasticity in a molten state and contains a releasing agent in order to avoid internal fracture of the molten toner, is used to eliminate the need for applying oil onto the fixing roller, or a system in which the toner is used to extremely decrease the application amount of oil.

Meanwhile, also in full-color image formations, an oil-less system has tended to be employed for decreasing in size of a fixing device and simplifying the structure thereof similarly to in monochrome image formations. However, in full-color image formations, there is a need to reduce the viscoelasticity of the toner in a molten state in order to smooth the surface of a fixed toner image. Therefore, the full-color image formations more easily cause the offset phenomenon than the non-glossy monochrome image formations, which makes it difficult to employ the oil-less system in the full-color image formations. When a releasing agent is incorporated into a toner, the toner is increased in adhesivity, so that transferability of the toner to a recording medium is degraded. Further, the incorporation of the releasing agent into the toner disadvantageously causes toner filming, leading to degradation in chargeability and thus in durability.

On the other hand, there have been various attempts to prolong service life of a carrier by coating the core surface of the carrier with a resin having a low-surface energy such as a fluoro-resin or a silicone resin, for the purpose of preventing the toner filming from occurring, forming a uniform carrier surface, preventing a carrier surface from being oxidized, preventing moisture-sensitivity from reducing, prolonging service life of a developer, preventing a carrier from adhering onto the surface of a photoconductor, protecting a photoconductor from being scratched or abraded, controlling charge polarity, and adjusting the charge amount.

Examples of the carrier coated with the resin having a low-surface energy include a carrier coated with a room temperature curable silicone resin and a positively charged nitrogen resin (see PTL 1), a carrier coated with a coating material containing at least one modified silicone resin (see PTL 2), a carrier having a coating layer containing a room temperature curable silicone resin and a styrene-acrylic resin (see PTL 3), a carrier in which the surface of a core particle is coated with two or more layers of a silicone resin so that the layers do not adhere to each other (see PTL 4), a carrier in which the surface of a core particle is coated with multiple layers of a silicone resin (see PTL 5), a carrier of which surface is coated with a silicone resin containing a silicon carbide (see PTL 6), a positively charged carrier coated with a material exhibiting critical surface tension of 20 dyn/cm or less (see PTL 7), and a carrier coated with a coating material containing fluoroalkyl acrylate (see PTL 8).

Recently, however, there has been increasingly a demand for higher speed, reduction in environmental waste load resulting from prolonging service life, and reduction in cost for printing per page in image forming apparatus. Therefore, there is a need for a carrier having higher durability.

On the other hand, resistivity is an important property for a carrier. The resistivity of the carrier is controlled so as to achieve an intended print quality depending on a system of image forming apparatus which is used in combination with the carrier. A coating layer of the carrier contains electroconductive particles as a material for controlling the resistivity. Exemplary examples of the electroconductive particles include carbon black, titanium oxide, zinc oxide, and ITO (indium tin oxide). Among them, a single-particle type carbon black and ITO coated with an electroconductive layer have been used as excellent electroconductive particles in many cases. For example, a carrier in which carbon black is used as electroconductive particles has been described (see PTL 9, PTL 10, and PTL 11). However, there is a need for improvement in the above carrier because it has not responded to a recent image forming under high stressed conditions, so that problematic color smear has been occurred.

Also, electroconductive particles in which base particles are coated with ITO serving as an electroconductive material have been described (see PTL 12, PTL 13, PTL 14, PTL 15, and PTL 16). However, in the case of the electroconductive particles in which base particles are coated with thin layers of the electroconductive material being excellent in electroconductive performance, when a carrier is formed therefrom and used in high-speed image forming apparatus, the thin layers of the electroconductive material which is exposed on the surfaces of carrier particles are scraped off due to collision of the carrier particles with each other within a developing device. As a result, the base particles having high hardness are rapidly exposed, so that resin coating layers in the carriers is acceleratedly decreased in impact resistance, further leading to scraping of the coating layers and decreasing in resistivity. Accordingly, carrier scattering occurs, which makes it impossible for the carrier to be used over a long period of time.

As such, in order to achieve a high-durable carrier, the option of electroconductive particles and a coating resin is selected is important.

CITATION LIST

Patent Literature

PTL 1 Japanese Patent Application Laid-Open (JP-A) No. 55-127569
PTL 2: JP-A No. 55-157751
PTL 3: JP-A No. 56-140358
PTL 4: JP-A No. 57-96355
PTL 5: JP-A No. 57-96356
PTL 6: JP-A No. 58-207054
PTL 7: JP-A No. 61-110161
PTL 8: JP-A No. 62-273576
PTL 9: JP-A No. 07-140723
PTL 10: JP-A No. 08-179570
PTL 11: JP-A No. 08-286429
PTL 12: Japanese Patent (JP-B) No. 4307352
PTL 13: JP-A No. 2006-79022
PTL 14: JP-A No. 2008-262155
PTL 15: JP-A No. 2009-186769
PTL 16: JP-A No. 2009-251483

SUMMARY OF INVENTION

Technical Problem

The present invention aims to provide an electrostatic latent image developing carrier used for a two-component developer used in an electrophotographic method or an electrostatic recording method which can achieve a high-durability, and a two-component developer, a supplemental developer, an image forming method, a process cartridge and an image forming apparatus using the carrier.

Solution to Problem

Means for solving the above problems are as follows.

A carrier including:

magnetic core particles; and a coating layer on a surface of each of the magnetic core particles, wherein the coating layer contains electroconductive particles;

wherein the electroconductive particles are electroconductive particles in which white inorganic pigments are coated with phosphorus-doped tin or tungsten-doped tin; and wherein a dope ratio of phosphorus or tungsten to tin in the phosphorus-doped tin or tungsten-doped tin is 0.010 to 0.100.

Advantageous Effects of Invention

According to the present invention, a carrier is provided which is obtained by applying to magnetic core particles a resin containing certain electroconductive particles in which white inorganic pigments are coated with phosphorus-doped tin or tungsten-doped tin serving as an electroconductive material, followed by subjected to a heat treatment to thereby polycondensate crosslinking components in the resin.

The carrier of the present invention results in a high-durable carrier and developer having a strong coating layer formed from silane-based crosslinking components having a low-surface energy and the electroconductive particles, being excellent in charge stability over a long period of time due to a control of resistivity, being less likely to vary in carrier resistivity or an amount of a supplied developer, having a reduced amount of the coating layer scraped or peeled off, suppressing toner spent, and being capable of preventing carrier adhesion.

In addition, the carrier suppresses charge variation depending on environment and prevents variation in image density, background smear, and contamination due to toner scattering in a developing device under various environments.

Also, the carrier exhibits an extremely excellent advantage of providing a high-reliable developing method and image forming apparatus.

DESCRIPTION OF EMBODIMENTS (Carrier)

Figure 1:
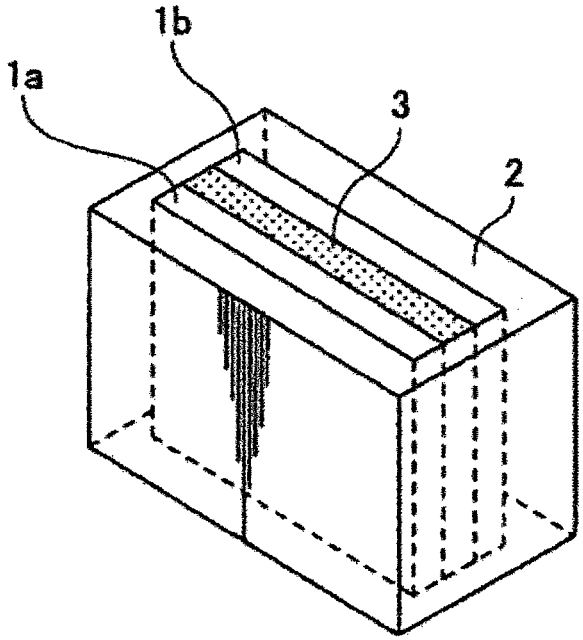
FIG. 1 illustrates an explanatory view of a measuring cell for measuring volume resistivity in the present invention.

A carrier of the present invention includes magnetic core particles and a coating layer on a surface of each of the magnetic core particles.

The coating layer contains electroconductive particles. The electroconductive particles are electroconductive particles in which white inorganic pigments are coated with phosphorus-doped tin or tungsten-doped tin.

The present inventors have found that durability can be ensured while maintaining image quality over time by, as an electrostatic latent image developing carrier, using a carrier having a certain structure in which electroconductive particles are contained in coating layers, the electroconductive particles including white inorganic pigments serving as base particles and phosphorus-doped tin serving as an electroconductive material coated onto the base particles.

An electrostatic latent image developing carrier of the present invention includes magnetic core particles and a coating layer on a surface of each of the magnetic core particles, the coating layer contains electroconductive particles, and the electroconductive particles are electroconductive particles in which white inorganic pigments are coated with phosphorus-doped tin serving as an electroconductive material.

In the present invention, it is extremely important to use electroconductive particles in which white inorganic pigments are coated with phosphorus-doped tin or tungsten-doped tin serving as an electroconductive material. As described above, carbon black and ITO have been used as electroconductive particles being excellent resistivity-controlling agents. However, in high-speed image forming apparatus, there have been occurred problems to be solved such as color smear under high stress conditions in the case of carbon black and a decrease of resistivity due to scraping of coating layers over time in the case of ITO.

The phosphorus-doped tin has lower resistivity-controlling ability than carbon black and ITO. Therefore, when forming electroconductive particles coated with electroconductive layers, i.e., electroconductive particles in which base particles are coated with an electroconductive material, phosphorus-doped tin or tungsten-doped tin must be used in a larger amount than that of ITO in order to attain electroconductive particles having the same powder specific resistivity as a whole. That is, the resultant electroconductive layers of the phosphorus-doped tin or the tungsten-doped tin are thicker than that of the ITO relative to particle diameters of base particles, which surprisingly results in an advantageous characteristic of the present invention.

That is, the electroconductive particles containing, as the electroconductive material, phosphorus-doped tin or tungsten-doped tin are exposed on the surfaces of carriers, so that they are unavoidably scraped off due to collision of the carrier particles with each other within a developing device in image forming apparatus similarly to the electroconductive particles containing ITO. However, they have thick coating layers, which prevent hard base particles from rapidly exposing. Therefore, the coating layers of the carriers are not rapidly scraped off, which enables image quality to be stably maintained over time.

In addition to the electroconductive particles containing tin as the electroconductive material, there are many other electroconductive particles such as those containing doped niobium, tantalum, antimony, or fluorine. However, phosphorus-doped tin or tungsten-doped tin is comprehensively suitable from the viewpoints of manufacturability, safety, and cost.

Secondarily, a coating ratio of the electroconductive material to the white inorganic pigments serving as base particles is also important. In the present invention, the following relationship is preferably met:

$$1.4 \leq R2/R1 \leq 2.6 \qquad \text{Relational expression (1)}$$

where R1 denotes a particle diameter of white inorganic pigments (μm) and R2 denotes a particle diameter of electroconductive particles (μm).

The smaller the R2/R1 is, the thinner the coating layer is; and the larger the R2/R1 is, the thicker the coating layer is. When R2/R1 is less than 1.3, the base particles are rapidly exposed, which facilitates scraping of the coating layer. When R2/R1 is, more than 2.6, the electroconductive particles become too large in a particle diameter to have a tendency to be separated from the coating layers due to collision of the carrier particles with each other, which increases resistivity of the carrier and thus may deteriorate image quality.

In the present invention, phosphorus-doped tin or tungsten-doped tin are used as the electroconductive material for the electroconductive particles. Adding a small amount of phosphorus or tungsten can achieve white electroconductive powder being excellent in electroconductivity and temporal stability, as well as being low in cost while maintaining whiteness.

When the dope ratio is less than 0.010, a desired electroconductivity can not be attained, which makes it difficult to control resistivity of carriers and deteriorates temporal stability of resistivity. When the dope ratio is more than 0.100, pigments serving as the base particles are decreased in whiteness due to coloring, which may cause color smear on an image and deteriorates temporal stability of charge. The dope ratio can be calculated from XPS measurement results obtained by, for example, AXIS-ULTRA (product of Kratos Group Plc.).

The volume average particle diameter of the electroconductive particles is preferably 0.35 μm to 0.65 μm. When the volume average particle diameter is less than 0.35 μm, the particles aggregate and become difficult to disperse in the form of a single particle. Accordingly, when formed into a carrier, the electroconductive particles are present in the form of a large aggregate, which fascinates a separation of the electroconductive particles from the coating layers. When the volume average particle diameter is more than 0.65 μm, the electroconductive particles also may tend to separate from the coating layers.

The R1 and the R2 can be measured by, for example, NANOTRAC UPA series (product of Nikkiso Co., Ltd.).

The electroconductive particles have preferably powder specific resistivity of 3 Ω·cm to 20 Ω·cm. The amount of the electroconductive particles incorporated in the carrier is determined depending on an intended resistivity. When the powder specific resistivity is less than 3 Ω·cm, the electroconductive particles become too large in a particle diameter to have a tendency to be separated from the coating layers. When the powder specific resistivity is more than 20 Ω·cm, the coating layers become thin, so that the base particles having high hardness are rapidly exposed, leading to scraping of the coating layers.

The powder specific resistivity of the electroconductive particles can be measured using, for example, LCR meter (product of Agilent Technologies, Inc.).

The white inorganic pigments serving as base particles in the electroconductive particles may be any of titanium dioxide, aluminium oxide, silicon dioxide, zinc oxide, barium sulfate, zirconium oxide, alkali metal salts of titanic acid, or muscovite. As an example, titanium dioxide will be explained in detail. Titanium dioxide is not particularly limited in particle diameter and shape (e.g., spherical or acicular). Also, titanium dioxide may be crystalline (e.g., anatase, rutile) or non-crystalline.

Notably, although the present invention puts emphasis on whiteness, the present invention can applied to various colored pigments such as iron oxide.

<Production Method of Electroconductive Particles>

A production method of the electroconductive particles is not particularly limited and may be, for example, as follows. Layers of tin salt hydrate containing phosphorus salt hydrate or tungsten salt hydrate are uniformly deposited on surfaces of white inorganic pigments to thereby obtain coating layers, following by firing.

For example, layers of tin salt hydrate containing phosphorus salt hydrate or tungsten salt hydrate can be uniformly deposited on surfaces of white inorganic pigments while preventing the white inorganic pigment particles from dissolving or being surface-modified with acids or alkalis as follows. The above phosphorus salt (e.g., phosphorus pentaoxide or $POCl_3$) or tungsten salt (e.g., tungsten chloride, tungsten oxychloride, sodium tungstate, or tungstic acid), and tin salt (e.g., tin salts such as tin chloride, tin sulfate, or tin nitrate; stannates such as sodium stannate or potassium stannate; or organic tin compounds such as tin alkoxide) are dissolved and dispersed to thereby obtain acidic aqueous liquid. The resultant acidic aqueous liquid and a pH-adjusting agent (e.g., basic aqueous liquid) are simultaneously added dropwise to an acidic aqueous liquid in which the white inorganic pigment particles have been dispersed. The pH-adjusting agent is used for precipitating or depositing the added phosphorus or tungsten and tin in the form of hydrate on the surfaces of the pigment particles.

Here, a dope rate of phosphorus or tungsten to $SnO_2$ can be controlled by controlling the amount of phosphorus or tungsten added dropwise and the amount of tin chloride solution added dropwise. However, of course, it is preferably noted that an isoelectric point of tin hydrate (i.e., tin hydroxide or stannic acid) is not necessarily the same as that of phosphorus or tungsten components, and that solubility of the tin hydrate at a certain pH may be different from that of the phosphorus or tungsten components. Water-soluble organic solvents (e.g., methanol or methyl ethyl ketone) may be mixed with the phosphorus salt or tungsten salt and tin salt in order to, upon adding dropwise, attenuate attack against the white inorganic pigment particles, prevent an excessive hydration reaction of phosphorus or tungsten and tin, and thus allow the coating layer to be uniform. The resultant hydrate may be preferably fired at 300° C. to 850° C. under non-oxidative atmosphere, which allows the volume resistivity of powder to be extremely low as compared to those have been heated in the air.

The electroconductive particles may be surface-treated, which allows overlaying electroconductive layers to adhere to the surfaces of the particles uniformly and tightly. Thus, the electroconductive particles can exhibit a satisfactory resistivity-controlling effect. The electroconductive particles may be surface-treated using, for example, an amino-based silane coupling agent, a methacryloxy-based silane coupling agent, a vinyl-based silane coupling agent, or a mercapto-based silane coupling agent.

The volume average particle diameter of the carrier is not particularly limited and may be appropriately selected depending on the intended purpose, but is preferably 32 μm to 40 μm. When the volume average particle diameter is less than 32 carrier adhesion may occur. When the volume average particle diameter is more than 40 μm, the resultant image may be deteriorated in reproducibility in details, which may prevent fine image formations.

The volume average particle diameter can be measured using, for example, MICROTRAC particle size analyzer Model HRA9320-X100 (product of Nikkiso Co., Ltd.).

The volume resistivity of the carrier is not particularly limited and may be appropriately selected depending on the intended purpose, but is preferably 8 (Log Ω·cm) to 14 (Log Ω·cm).

When the volume resistivity is less than 8 (Log Ω·cm), carrier deposition may occur in non-image portions. When the volume resistivity is more than 14 (Log Ω·cm), an unacceptable degree of the edge effect may occur.

The volume resistivity of the carrier can be measured using a measuring cell illustrated in FIG. 1 as follows. The measuring cell is comprised of a fluoro-resin container 2 in which electrodes 1*a* and 1*b* each having the surface area of 2.5 cm×4 cm are placed at a distance of 0.2 cm apart from each other. The measuring cell is filled with a carrier 3 and tapped from a height of 1 cm for 10 times at a tapping speed of 30 times/min. Thereafter, a direct current voltage of 1,000 V is applied to between the electrodes 1*a* and 1*b* for 30 seconds to measure the resistivity r[Ω] by a high resistance meter 4329A (product of Agilent Technologies, Inc.). The volume resistivity [Ω·cm] of the carrier can be calculated from the following Calculation formula (2):

$$r\times(2.5\times4)/0.2 \qquad \text{Calculation formula (2)}$$

As coating resins of the carrier, for example, silicone resins, acrylic resins, or a combination thereof may be used. The acrylic resins have high adhesiveness and low brittleness, meaning that acrylic resins have an excellent abrasion resistance. However, since the acrylic resins have high-surface energy, a problem may occur such as a decrease in the amount of charge caused by accumulation of toner component spent when used in combination with a toner having a tendency to be spent. This problem can be solved by using silicone resins in combination because silicone resins have low-surface energy, so that toner component is less likely to be spent and thus spent component which causes scraping of the coating layers does not easily accumulate. However, silicone resins have low adhesiveness and high brittleness, meaning that silicone resins have a disadvantage of low abrasion resistance. Therefore, it is essential to use the above 2 resins in a balanced manner to obtain coating layers which suppress toner spent and have abrasion resistance, which results in significant improving effect. This is because silicone resins have low-surface energy, so that toner component is less likely to be spent and thus spent component which causes scraping of the coating layers does not easily accumulate.

The term "silicone resin" as used herein refers to any generally known silicone resins. Examples thereof include straight silicone resins which contain organo-siloxane bonds only; and modified silicone resins modified with, for example, alkyd resins, polyester resins, epoxy resins, acrylic resins, or urethane resins.

The silicone resins may be commercially available products. Examples of commercially available straight silicone resins include KR271, KR255 and KR152 (these products are of Shin-Etsu Chemical Co., Ltd.); and SR2400, SR2406 and SR2410 (these products are of Dow Corning Toray Silicone Co., Ltd.). These silicone resins may be used alone or in combination with, for example, components undergoing crosslinking reaction, and components for adjusting the charged amount.

Examples of commercially available modified silicone resins include KR206 (alkyd-modified resin), KR5208 (acrylic-modified resin), ES1001N (epoxy-modified resin) and KR305 (urethane-modified resin) (these products are of Shin-Etsu Chemical Co., Ltd.); and SR2115 (epoxy-modified resin) and SR2110 (alkyd-modified resin) (these products are of Dow Corning Toray Silicone Co., Ltd.).

A polycondensation catalyst is used for polycondensing silicone resins. Crosslinking the resins together can impart strength to the coating layer.

Examples of the polycondensation catalyst include titanium-based catalysts, tin-based catalysts, zirconium-based catalysts, or aluminum-based catalysts. Among them, titanium-based catalysts are preferred and titanium diisopropoxybis(ethyl acetoacetate) is most preferred. This is believed because the above catalysts effectively accelerate condensation reaction of silanol group and are not easily inactivated.

The term "acrylic resin" as used herein refers to any resin containing an acrylic component and is not particularly limited. The acrylic resin may be used alone, or in combination with at least one other components crosslinking therewith. Examples of the other components crosslinking therewith include, but not limited to, amino resins and acidic catalysts. Examples of the amino resins include guanamine and melamine resins. The term "acidic catalyst" as used herein refers to any those having a catalytic function. Examples thereof include, but not limited to, those having a reactive group such as a complete alkyl group, a methylol group, an imino group and a methylol/imino group.

The coating layer preferably further contains a crosslinked product of an acrylic resin and an amino resin, which suppresses fusion of coating layers with each other while maintaining proper elasticity.

The amino resin is not particularly limited and may be appropriately selected depending on the intended purpose, but is preferably melamine resins or benzoguanamine resins from the viewpoint of being capable of improving charge giving ability of the resultant carrier. In the case where the charge giving ability is needed to be properly controlled, the melamine resins, the benzoguanamine resin, or a combination thereof may be used in combination with another amino resin.

Acrylic resins which can crosslink with the amino resins are preferably those having a hydroxyl group, a carboxyl group, or a combination thereof, and are more preferably those having a hydroxyl group from the viewpoint of being capable of improving adhesiveness with the core particles or electroconductive particles, and dispersion stability of the electroconductive particle. The acrylic resin preferably has a hydroxyl value of 10 mgKOH/g or more, more preferably 20 mgKOH/g or more.

—Silane Coupling Agent—

The coating layers preferably contain a silane coupling agent, which can stably disperse the electroconductive particles.

The silane coupling agent is not particularly limited and may be appropriately selected depending on the intended purpose. Examples thereof include r-(2-aminoethyl)aminopropyl trimethoxysilane, r-(2-aminoethyl)aminopropylmethyl dimethoxysilane, r-methacryloxypropyl trimethoxysilane, N-β-(N-vinylbenzylaminoethyl)-r-aminopropyl trimethoxysilane hydrochloride, r-glycidoxypropyl trimethoxysilane, r-mercaptopropyl trimethoxysilane, methyl trimethoxysilane, methyl triethoxysilane, vinyl triacetoxysilane, r-chloropropyl trimethoxysilane, hexamethyl disilazane, r-anilinopropyl trimethoxysilane, vinyl trimethoxysilane, octadecyldimethyl[3-(trimethoxysilyl) propyl]ammonium chloride, r-chloropropylmethyl dimethoxysilane, methyl trichlorosilane, dimethyl dichlorosilane, trimethyl chlorosilane, allyl triethoxysilane, 3-aminopropylmethyl diethoxysilane, 3-aminopropyl trimethoxysilane, dimethyl diethoxysilane, 1,3-divinyltetramethyl disilazane, and methacryloxyethyldimethyl(3-trimethoxysilylpropyl) ammonium chloride. These may be used alone or in combination.

The silane coupling agent may be commercially available products. Examples of thereof include AY43-059, SR6020, SZ6023, SH6026, SZ6032, SZ6050, AY43-310M, SZ6030, SH6040, AY43-026, AY43-031, sh6062, Z-6911, sz6300, sz6075, sz6079, sz6083, sz6070, sz6072, Z-6721, AY43-004, Z-6187, AY43-021, AY43-043, AY43-040, AY43-047, Z-6265, AY43-204M, AY43-048, Z-6403, AY43-206M, AY43-206E, Z6341, AY43-210 MC, AY43-083, AY43-101, AY43-013, AY43-158E, Z-6920, and Z-6940 (these products are of Dow Corning Toray Co., Ltd.). These may be used alone or in combination.

The amount of the silane coupling agent is preferably 0.1% by mass to 10% by mass relative to that of the silicone resin. When the amount is less than 0.1% by mass, adhesiveness between the silicone resin and the core particles or the electroconductive particles may be poor, potentially leading to exfoliation of the coating layers during a long-term use. When the amount is more than 10% by mass, toner filming may occur during a long-term use.

The coating layers completely coat the core particles without deficiency, and preferably have the average thickness of 0.05 μm to 0.5 μm. When the average thickness is less than 0.05 μm, the coating layers may be easily destroyed or scraped upon using. When the average thickness is more than 0.5 μm, the carrier may easily adhere onto images because the coating layers are non-magnetic, and the below-described resistivity-controlling effect becomes difficult to be well exhibited.

The core particles are not particularly limited as long as they are magnetic. Examples thereof include ferromagnetic metals (e.g., iron or cobalt); iron oxides (e.g., magnetite, hematite or ferrite); various alloys or compounds; and resin particles in which any of the above are dispersed in a resin. Among them, Mn ferrite, Mn—Mg ferrite, and Mn—Mg—Sr ferrite are preferred because they are environment-friendly.

(Two-Component Developer)

A two-component developer of the present invention contains the carrier of the present invention and a toner.

<Toner>

The toner contains a binder resin and a colorant; and, if necessary, further contains other ingredients.

The toner may be either a monochrome toner or a color toner. The toner may contain a release agent in order to adapt to an oilless system in which a toner adhesion preventing oil is not applied onto a fixing roller. Although such a toner containing a release agent, in general, easily causes filming, the carrier of the present invention can suppress the occurrence of filming. Therefore, the two-component developer of the present invention can maintain high-image quality over a long period of time.

In addition, a color toner, in particular, a yellow toner has a disadvantage of occurring color smear due to scraping of coating layers in carrier. However, the two-component developer of the present invention can suppress color smear from occurring.

The toner can be produced by known methods such as pulverization methods or polymerization methods. For example, in the case of pulverization method, toner materials are firstly kneaded together to thereby obtain a melt-kneaded product. The melt-kneaded product is cooled, followed by pulverizing and classifying to thereby produce toner base particles. Then, in order to further improve transferability and durability, an external additive is added to the toner base particles to thereby produce a toner.

The kneaders for keading the toner materials are not particularly limited and may be appropriately selected depending on the intended purpose. Examples thereof include a batch-type two-roll mill; Banbury mixer; twin screw continuous extruders such as KTK-type twin screw extruder (product of Kobe Steel, Ltd.), TEM-type twin screw extruder (product of Toshiba Machine Co., Ltd.), twin screw extruder (product of KCK Co., Ltd.), PCM-type twin screw extruder (product of Ikegai Corp), and KEX-type twin screw extruder (product of Kurimoto, Ltd.); and single screw continuous kneaders such as KO-KNEADER (product of Buss Corporation).

The cooled melt-kneaded product may be pulverized into coarse particles by, for example, a hammer mill or a roatplex, and then further pulverized into fine particles by, for example, a pulverizer utilizing jet-stream or a mechanical pulverizer. The cooled melt-kneaded product is preferably pulverized so as to have the average particle diameter of 3 μm to 15 μm.

The pulverized melt-kneaded product may be classified by, for example, a wind-power classifier. The pulverized melt-kneaded product is preferably classified so that the resultant toner base particles have the average particle diameter of 5 μm to 20 μm.

In the case of adding the external additive to the toner base particles, they are mixed together and agitated by a mixer so that the external additive is adhered to the surfaces of the toner base particles while being pulverized.

—Binder Resin—

The binder resin is not particularly limited and may be appropriately selected depending on the intended purpose. Examples thereof include polyester; homopolymers of styrene and substituted styrenes such as polystyrenes, poly-p-styrenes, and polyvinyltoluenes; styrenic copolymers such as styrene-p-chlorostyrene copolymers, styrene-propylene copolymers, styrene-vinyltoluene copolymers, styrene-methyl acrylate copolymers, styrene-ethyl acrylate copolymers, styrene-methacrylic acid copolymers, styrene-methyl methacrylate copolymers, styrene-ethyl methacrylate copolymers, styrene-butyl methacrylate copolymers, styrene-α-chloromethylmethacrylate copolymers, styrene-acrylonitrile copolymers, styrene-vinylmethylether copolymers, styrene-vinylmethylketone copolymers, styrene-butadiene copolymers, styrene-isoprene copolymers, styrene-maleic ester copolymers; polymethyl methacrylate, polybutyl methacrylate, polyvinyl chloride, polyvinyl acetate, polyethylene, polyurethane, epoxy resins, polyvinyl butyral, polyacrylic acid, rosins, modified rosins, terpene resins, phenolic resins, aliphatic or aromatic hydrocarbon resins, and aromatic petrolium resins. These may be used alone or in combination.

The binder resins for pressure fixing is not particularly limited and may be appropriately selected depending on the intended purpose. Examples thereof include polyolefins such as low-molecular weight polyethylene or low-molecular weight polypropylene; olefinic copolymers such as ethylene-acrylic acid copolymer, ethylene-acrylic ester copolymer, styrene-methacrylic acid copolymer, ethylene-methacrylic ester copolymer, ethylene-vinyl chloride copolymer, ethylene-vinyl acetate copolymer, or ionomer resins; epoxy resins, polyester, styrene-butadiene copolymer, polyvinyl pyrrolidone, methyl vinyl ether-maleic anhydride copolymer, maleic-modified phenol resins, and phenol-modified terpene resin. These may be used alone or in combination.

—Colorant—

The colorant (pigment or dye) is not particularly limited and may be appropriately selected depending on the intended purpose. Examples thereof include yellow pigments such as Cadmium Yellow, Mineral Fast Yellow, Nickel Titan Yellow, Naples Yellow, Naphthol Yellow S, Hansa Yellow G, Hansa Yellow 10G, Benzidine Yellow GR, Quinoline Yellow Lake, Permanent Yellow NCG, and Tartrazine Lake; orange pigments such as Molybdate Orange, Permanent Orange GTR, Pyrazolone Orange, Vulcan Orange, Indanthrene Brilliant Orange RK, Benzidine Orange G, and Indanthrene Brilliant Orange GK; red pigments such as red iron oxide, Cadmium Red, Permanent Red 4R, Lithol Red, Pyrazolone Red, Watchung Red Calcium Salt, Lake Red D, Brilliant Carmine 6B, Eosine Lake, Rhodamine Lake B, Alizarine Lake, and Brilliant Carmine 3B; purple pigments such as Fast Violet B and Methyl Violet Lake; blue pigments such as Cobalt Blue, Alkali Blue, Victoria Blue Lake, Phthalocyanine Blue, metal-free Phthalocyanine Blue, partially chlorinated Phthalocyanino Blue, Fast Sky Blue, and Indanthrene Blue BC; green pigments such as Chrome Green, chromium oxide, Pigment Green B, and Malachite Green Lake; black pigments such as carbon black, oil furnace black, channel black, lamp black, acetylene black, azine dyes such as aniline black, azo dyes of metal salts, metal oxides, and complex metal oxides. These may be used alone or in combination.

—Releasing Agent—

The releasing agent is not particularly limited and may be appropriately selected depending on the intended purpose. Examples of thereof include polyethylene, polyolefins (e.g., polypropylene), fatty acid metal salts, fatty acid esters, paraffin waxes, amide waxes, polyvalent alcohol waxes, silicone varnishes, carnauba waxes, and ester waxes. These may be used alone or in combination.

—Other Ingredients—

Examples of the other ingredients include a charge controlling agent and an external additive.

—Charge Controlling Agent—

The toner may further contain a charge controlling agent. The charge controlling agent is not particularly limited and may be appropriately selected depending on the intended purpose. Examples thereof include nigrosine; C2-C16 alkyl group-containing azine dyes (see JP-B No. 42-1627); basic dyes such as C.I. Basic Yellow 2 (C.I. 41000), C.I. Basic Yellow 3, C.I. Basic Red 1 (C.I. 45160), C.I. Basic Red 9 (C.I. 42500), C.I. Basic Violet 1 (C.I. 42535), C.I. Basic Violet 3 (C.I. 42555), C.I. Basic Violet 10 (C.I. 45170), C.I. Basic Violet 14 (C.I. 42510), C.I. Basic Blue 1 (C.I. 42025), C.I. Basic Blue 3 (C.I. 51005), C.I. Basic Blue 5 (C.I. 42140), C.I. Basic Blue 7 (C.I. 42595), C.I. Basic Blue 9 (C.I. 52015), C.I. Basic Blue 24 (C.I. 52030), C.I. Basic Blue 25 (C.I. 52025), C.I. Basic Blue 26 (C.I. 44045), C.I. Basic Green 1 (C.I. 42040), and C.I. Basic Green 4 (C.I. 42000); lake pigments of these basic dyes; C.I. Solvent Black 8 (C.I. 26150); quaternary ammonium salts such as benzoylmethylhexadecylammonium chloride and decyltrimethyl chloride; dialkyl (e.g. dibutyl or dioctyl) tin compounds; dialkyltin borate compounds; guanidine derivatives; polyamine resins such as amino group-containing vinyl polymers or amino group-containing condensation polymers; metal complex salts of the monoazo dyes described in JP-B Nos. 41-20153, 43-27596, 44-6397 and 45-26478; metal (e.g. Zn, Al, Co, Cr, or Fe) complexes of salicylic acid, dialkylsalicylic acids, naphthoic acid or dicarboxylic acids described in JP-B Nos. 55-42752 and 59-7385; sulfonated copper phthalocyanine pigments; organic boron salts; fluorine-containing quaternary ammonium salts; and calixarene compounds. These may be used alone or in combination.

Regarding color toners other than a black toner, metal salts such as salicylic acid derivatives which are white in color are preferred.

—External Additive—

The external additive is not particularly limited and may be appropriately selected depending on the intended purpose. Examples thereof include inorganic particles such as silica, titanium oxide, alumina, silicon carbide, silicon nitride, and boron nitride; and resin particles (e.g., polymethyl methacrylate particles or polystyrene particles) having the average particle diameter of 0.05 μm to 1 μm obtained by soap-free emulsion polymerization. These may be used alone or in combination.

Among them, surface-hydrophobized metal oxide (e.g., silica and titanium oxide) particles are preferred. When hydrophobized silica and hydrophobized titanium oxide are used in combination and the amount of the hydrophobized titanium oxide is greater than that of the hydrophobized silica, a toner being excellent in charge stability regardless of humidity can be achieved.

(Supplemental Developer)

A supplemental developer of the present invention contains the carrier of the present invention and a toner.

Stable image quality can be attained over a very long period of time by producing a supplemental developer containing the carrier and a toner using the carrier of the present invention, and then supplying it to image forming apparatus in which an image is formed while discharging an excess of developer within a developing unit. In other words, deteriorated carrier within the developing unit is replaced with fresh carrier contained in the supplemental developer, which maintains a charge amount at a constant level and thus achieves stable image quality over a long period of time. The use of supplemental developer is effective when printing a large image region. In printing a large image region, a carrier is deteriorated mainly by charge deterioration due to toner spent. However, when using the supplemental developer, a larger amount of carrier is supplied as a larger image region is printed. Thus, the frequency at which the deteriorated carrier is replaced with fresh carrier is increased, which achieves stable image quality over a long period of time.

The supplemental developer preferably contains 2 parts by mass to 50 parts by mass of the toner relative to 1 part by mass of the carrier. When the amount of the toner is less than 2 parts by mass, a charge amount of the developer tends to increase because an excessive amount of the carrier is supplied, i.e., the carrier is oversupplied, leading to an undesirably high concentration of the carrier within a developing unit. In addition, an increase of the charge amount of the developer deteriorates developability and thus lowers image density. When the amount of toner is more than 50 parts by mass, the frequency at which the deteriorated carrier is replaced with fresh carrier is decreased, which makes it impossible to exhibit a satisfactory effect against carrier deterioration.

(Image Forming Method and Image Forming Apparatus)

An image forming method of the present invention includes an electrostatic latent image forming step, a developing step, a transfer step and a fixing step; and, if necessary, further includes other steps such as a charge eliminating step, a cleaning step, a recycling step and a controlling step.

An image forming apparatus of the present invention includes an electrostatic latent image bearing member, an electrostatic latent image forming unit, a developing unit, a transfer unit and a fixing unit; and, if necessary, further includes other appropriately selected units such as a charge eliminating unit, a cleaning unit, a recycling unit and a controlling unit.

<Electrostatic Latent Image Forming Step and Electrostatic Latent Image Forming Unit>

The electrostatic latent image forming step is a step of forming an electrostatic latent image on an electrostatic latent image bearing member.

The material, shape, structure, size of the electrostatic latent image bearing member (hereinafter may be referred to as "electrophotographic photoconductor", "photoconductor" or "image bearing member") are not particularly limited and may be appropriately selected from those known in the art. Suitable examples of the shape include drum-like shapes. Examples of material include inorganic photoconductors such as amorphous silicon or selenium, or organic photoconductors such as polysilane or phthalopolymethine. Among them, amorphous silicon are preferred from the viewpoint of long service life.

The electrostatic latent image can be formed, for example by uniformly charging the surface of the electrostatic latent image bearing member and then exposing the surface imagewise. The electrostatic latent image can be formed by the electrostatic latent image forming unit. For example, the electrostatic latent image forming unit includes at least a charging device configured to uniformly charge the surface of the electrostatic latent image bearing member, and an exposing device configured to expose the surface of the electrostatic latent image bearing member imagewise.

The charging can be performed, for example, by applying voltage to the surface of the electrostatic latent image bearing member using a charging device.

The charging device is not particularly limited and may be appropriately selected depending on the intended purpose. Examples thereof include known contact-type charging devices provided with, for example, electroconductive or semielectroconductive rolls, brushes, films or rubber blades and non-contact-type charging devices utilizing corona discharge, such as corotron chargers and scorotron chargers.

The exposure can be performed, for example, by exposing the surface of the electrostatic latent image bearing member imagewise using an exposing device.

The exposing device is not particularly limited and may be appropriately selected depending on the intended purpose as long as it can expose, in the intended imagewise manner, the surface of the electrostatic latent image bearing member charged by the charging device. Examples thereof include exposing devices which employ a copying optical system, a rod lens array system, a laser optical system, and a liquid crystal shutter optical system.

Notably, in the present invention, a backlighting method may be employed in which imagewise exposure is performed from the back surface side of the electrostatic latent image bearing member.

<Developing Step and Developing Unit>

The developing step is a step of developing the electrostatic latent image using the developer of the present invention to thereby form a visible image.

The visible image can be formed, for example, by developing the electrostatic latent image using the developer of the present invention, which can be performed by the developing unit.

The developing unit is not particularly limited and may be appropriately selected from those known in the art as long as it can develop the electrostatic latent image using the developer of the present invention. Suitable examples thereof include a developing unit provided with at least a developing device which houses the developer of the present invention and which is capable of supplying the developer to the electrostatic latent image in a contact or non-contact manner.

The developing device may be of dry developing type or of wet developing type, and may be a developing device for a single color or a developing device for multiple colors. Suitable examples thereof include a developing device provided with a stirrer for charging the toner set or the developer set with friction generated during stirring, and a rotatable magnet roller.

In the developing device, for example, the toner are mixed and stirred with the carrier, the toner is charged by the friction generated upon the mixing and stirring, and toner particles are held in the chain-like form on the surface of the rotating magnet roller, thereby forming a magnetic brush. Since the magnet roller is placed in the vicinity of the electrostatic latent image bearing member (photoconductor), a part of the toner constituting the magnetic brush formed on the surface of the magnet roller moves to the surface of the electrostatic latent image bearing member (photoconductor) by electrical suction. As a result, the electrostatic latent image is developed with the toner, and a visible image made of the toner is formed on the surface of the electrostatic latent image bearing member (photoconductor).

<Transfer Step and Transfer Unit>

The transfer step is a step of transferring the visible image to a recording medium. In a preferred aspect of the transfer step, an intermediate transfer member is used, a visible image is primarily transferred onto the intermediate transfer member and then the visible image is secondarily transferred onto a recording medium. In a more preferred aspect of the transfer step, toners of two or more colors, preferably full-color toners are used, and there are included a primary transfer step of transferring visible images onto an intermediate transfer member to thereby form a compound transfer image thereon, and a secondary transfer step of transferring the compound transfer image onto a recording medium.

The transfer can be performed, for example, by charging the visible image on the electrostatic latent image bearing member (photoconductor) using a transfer charging device, which can be performed by the transfer unit. A preferred aspect of the transfer unit includes a primary transfer unit configured to transfer visible images onto an intermediate transfer member to thereby form a compound transfer image thereon, and a secondary transfer unit configured to transfer the compound transfer image onto a recording medium.

The intermediate transfer member is not particularly limited and may be appropriately selected from known transfer members. Suitable examples thereof include transfer belts.

The transfer unit (the primary transfer unit and the secondary transfer unit) preferably includes at least a transfer device configured to transfer the visible images formed on the electrostatic latent image bearing member (photoconductor) onto the recording medium through charging. One transfer unit, or two or more transfer units may be provided.

Examples of the transfer device include corona transfer devices utilizing corona discharge, transfer belts, transfer rollers, pressure transfer rollers and adhesion transfer devices.

The recording medium is not particularly limited and may be appropriately selected from known recording media (recording papers).

<Fixing Step and Fixing Unit>

The fixing step is a step of fixing the visible image transferred to the recording medium using a fixing unit. The fixing may be performed for each color toner at every transferring onto the recording medium or may be performed for color toner images all together in a state where all the color toner images are superimposed.

The fixing unit is not particularly limited and may be appropriately selected depending on the intended purpose, but is preferably known heating and pressurizing units. Examples of the heating and pressurizing unit include a combination of a heating roller and a pressurizing roller, and a combination of a heating roller, a pressurizing roller and an endless belt.

In general, the temperature at which heating is performed by the heating and pressurizing unit is preferably 80° C. to 200° C.

Notably, in the present invention, an optical fixing device known in the art may, for example, be used together with or instead of the fixing step and the fixing unit.

<Other Steps and Other Units>

Examples of the other steps include a charge eliminating step, a cleaning step, a recycling step and a controlling step.

Examples of the other units include a charge eliminating unit, a cleaning unit, a recycling unit and a controlling unit.

—Charge Eliminating Step and Charge Eliminating Unit—

The charge eliminating step is a step of eliminating charge by applying a charge eliminating bias to the electrostatic latent image bearing member, which can be performed by the charge eliminating unit.

The charge eliminating unit is not particularly limited and may be appropriately selected from known charge eliminating devices as long as it can apply a charge eliminating bias to the electrostatic latent image bearing member. Suitable examples thereof include charge eliminating lamps.

—Cleaning Step and Cleaning Unit—

The cleaning step is a step of removing the toner remaining on the electrostatic latent image bearing member, which can be performed by the cleaning unit.

The cleaning unit is not particularly limited and may be appropriately selected from known cleaners as long as it can remove the electrophotographic toner remaining on the electrostatic latent image bearing member. Suitable examples thereof include magnetic brush cleaners, electrostatic brush cleaners, magnetic roller cleaners, blade cleaners, brush cleaners and web cleaners.

—Recycling Step and Recycling Unit—

The recycling step is a step of recycling the toner removed by the cleaning step to the developing unit, which can be performed by the recycling unit.

The recycling unit is not particularly limited and may be known conveyance units.

—Control Step and Control Unit—

The control step is a step of controlling each of the above steps, which can be suitably performed by the control unit.

The control unit is not particularly limited and may be appropriately selected depending on the intended purpose as long as it can control the operation of each of the above units. Examples thereof include apparatuses such as sequencers and computers.

(Process Cartridge)

A process cartridge of the present invention includes at least an electrostatic latent image bearing member; and a developing unit configured to develop with the use of the developer the electrostatic latent image formed on the electrostatic latent image bearing member to thereby form a visible image; and, if necessary, further includes other units.

The developer is the two-component developer of the present invention or the supplemental developer of the present invention.

Figure 2:
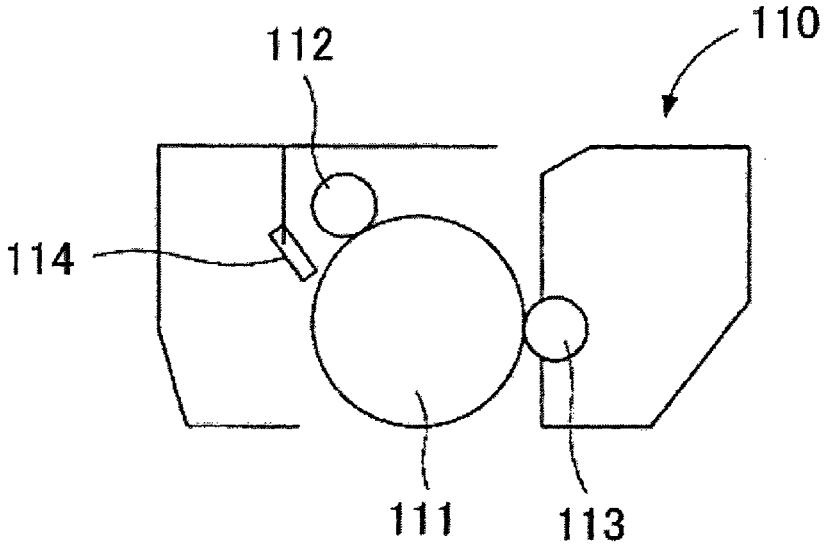
FIG. 2 illustrates one exemplary process cartridge according to the present invention.

FIG. 2 illustrates one exemplary process cartridge according to the present invention. A process cartridge 110 shown in FIG. 2 includes a photoconductor 111; a charging unit 112 configured to charge the photoconductor 111; a developing device 113 configured to develop with the use of the developer of the present invention an electrostatic latent image formed on the photoconductor 111 into a toner image; and a cleaning unit 114 configured to remove residual toner remaining on the photoconductor 111 after the toner image formed on the photoconductor 111 is transferred onto a recording medium, which are integrally supported. The process cartridge 110 is detachably attached to image forming apparatus such as copiers and printers.

An image forming method using an image forming apparatus provided with the process cartridge 110 now will be explained. The photoconductor 111 is driven to rotate at a predetermined peripheral speed. A peripheral surface of the photoconductor 111 is uniformly charged to a predetermined positive or negative potential by the charging unit 112. The charged peripheral surface of the photoconductor 111 is irradiated with an exposing light emitted from an exposing device (e.g., a slit exposing device or a scanning exposing device using laser beam) (not shown) to thereby sequentially form an electrostatic latent image. The electrostatic latent image formed on the peripheral surface of the photoconductor 111 is developed with the developer of the present invention into a toner image by the developing unit 113. The toner image formed on the peripheral surface of the photoconductor 11 is sequentially transferred onto a transfer paper that is fed to between the photoconductor 111 and a transfer device (not shown) from a paper feeding portion (not shown) in synchronization with rotation of the photoconductor 111. The transfer paper on which the toner image has been transferred is separated from the peripheral surface of the photoconductor 111 and introduced into a fixing device (not shown), where the toner image is fixed on the transfer paper. Thereafter, the transfer paper is discharged as a copy from the image forming apparatus. The cleaning unit 114 removes residual toner remaining on the peripheral surface of the photoconductor 111 from which the toner image has been transferred. The cleaned photoconductor 111 is charge-eliminated by a charge eliminating unit (not shown) to be ready for a next image forming operation.

Figure 3:
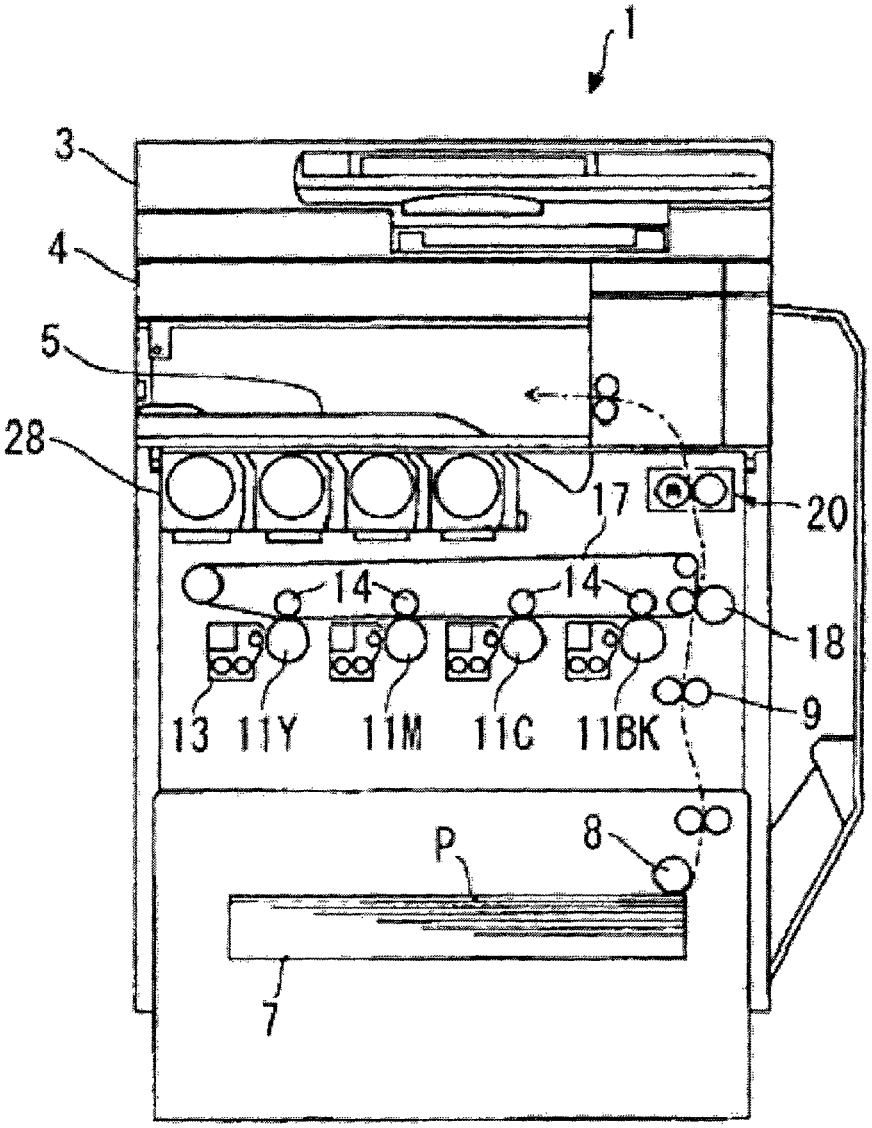
FIG. 3 schematically illustrates one exemplary image forming apparatus of the present invention.

FIG. 3 schematically illustrates one exemplary image forming apparatus of the present invention. In FIG. 3, reference numeral "1" denotes an apparatus main body of a tandem color copier as an image forming apparatus, "3" denotes a document feeding section which feeds documents to a document reading section, "4" denotes a document reading section which reads image information of the document, "5" denotes a discharge tray on which output images are to be stacked, "7" denotes a paper feeding section in which recording media P such as transfer paper are housed, "9" denotes registration rollers which adjust the timing of conveyance of the recording media P, "11Y", "11M", "11C" and "11BK" are photoconductor drums serving as image bearing members on which toner images of colors (yellow, magenta, cyan and black) are to be formed, "13" denotes a developing device which develops an electrostatic latent image formed on each of the photoconductor drums 11Y, 11M, 11C and 11BK, "14" denotes a transfer bias roller (a primary transfer bias roller) which transfers the toner images formed on the photoconductor drums 11Y, 11M, 11C and 11BK to the recording media P on top of one another.

Also, "17" denotes an intermediate transfer belt onto which toner images of colors are to be transferred on top of one another, "18" denotes a secondary transfer bias roller for transferring the color toner images on the intermediate transfer belt 17 onto the recording media P, "20" denotes a fixing device which fixes an unfixed image on the recording media P, and "28" denotes a container for each color toner which supplies a toner (toner particles) of each color (yellow, magenta, cyan or black) to the developing device 13.

EXAMPLES

The present invention, hereinafter, will be specifically explained with reference to the following Examples and Comparative Examples. However, the present invention is not limited thereto.

Production Example 1 of Core Particles $MnCO_3$, $Mg(OH)_2$, $Fe_2O_3$, and $SrCO_3$ were weighed and mixed in the form of powder to thereby obtain mix powder.

The mix powder was calcined in a heating furnace at 850° C. for 1 hour under atmosphere. The resultant calcined mix powder was cooled, and then pulverized to obtain powder having the particle diameter of 3 μm or less. The powder and a 1% by mass dispersing agent were added to water to thereby obtain slurry. The slurry was granulated in a spray drier to thereby obtain granules having the average particle diameter of about 40 μm. The granules were charged into a firing furnace and fired at 1,120° C. for 4 hours under nitrogen atmosphere.

The resultant fired product was cracked with a cracking machine and sieved for adjusting particle size thereof to thereby obtain spherical ferrite particles C1 having the volume average particle diameter of about 35 μm.

Production Example 2 of Core Particles $MnCO_3$, $Mg(OH)_2$, and $Fe_2O_3$ were weighed and mixed in the form of powder to thereby obtain mix powder. The mix powder was calcined in a heating furnace at 900° C. for 3 hours under atmosphere. The resultant calcined mix powder was cooled, and then pulverized to obtain powder having the particle diameter of about 7 μm. The powder and a 1% by mass dispersing agent were added to water to thereby obtain slurry. The slurry was granulated in a spray drier to thereby obtain granules having the average particle diameter of about 40 μm.

The granules were charged into a firing furnace and fired at 1,250° C. for 5 hours under nitrogen atmosphere.

The resultant fired product was cracked with a cracking machine and sieved for adjusting particle size thereof to thereby obtain spherical ferrite particles C2 having the volume average particle diameter of about 35 μm.

The volume average particle diameter was measured in water using MICROTRAC particle size analyzer HRA9320-X100 (product of Nikkiso Co., Ltd.) with the following settings: refractive index of sample: 2.42; refractive index of solvent: 1.33; and concentration: about 0.06.

Production Example 1 of Electroconductive Particles

A suspension liquid was prepared by dispersing 100 g of aluminum oxide (AKP-30, product of Sumitomo Chemical Co., Ltd.) in 1 L of water, followed by heating to 65° C. A solution of stannic chloride (77 g) and phosphorus pentoxide (0.8 g) in 2N hydrochloric acid (1.7 L) and a 12% by mass ammonia water were added dropwise to the suspension liquid for 1 hour 30 min so as to have a pH of 7 to 8. After completion of dropwise addition, the suspension liquid was filtered and washed to thereby obtain a cake. The cake was dried at 110° C. The resultant dried powder was treated at 500° C. for 1 hour under nitrogen gas flow to thereby obtain electroconductive particles P1, which were found to have the volume average particle diameter of 0.30 μm, the dope ratio of 0.010, and the powder specific resistivity of 24 Ω·cm.

The volume average particle diameter was measured in water using NANOTRAC UPA-EX150 (product of Nikkiso Co., Ltd.) with the following settings: refractive index of sample: 1.66 and refractive index of solvent: 1.33.

The powder specific resistivity of the electroconductive particles was obtained as follows. A sample powder was compression molded at 230 kg/cm$^2$, and then measured for electrical resistivity using LCR meter (product of Agilent Technologies, Inc.). Based on the electrical resistivity, the specific resistivity was calculated.

The dope ratio was obtained by measuring for XPS using the following device and conditions, and calculating from the detected amount (% by atom).

Measuring device: AXIS-ULTRA (product of Kratos Group Plc.).

Measuring light source: A1 (monochromator)

Measuring output: 105 W (15 kV, 7 mA)

Measuring area: 900×600 μm$^2$

Pass energy: (wide scan) 160 eV, (narrow scan) 40 eV

Energy step: (wide scan) 1.0 eV, (narrow scan) 0.2 eV

Magnet Controller: ON

Relative sensitivity factor: using the relative sensitivity factor available from Kratos Group Plc.

Production Example 2 of Electroconductive Particles

Electroconductive particles P2 were obtained in the same manner as in Production Example 1 of electroconductive particles, except that 2,100 g of stannic chloride and 23 g of phosphorus pentoxide were added dropwise for 42 hours. The electroconductive particles P2 were found to have the volume average particle diameter of 0.70 μm, the dope ratio of 0.010, and the powder specific resistivity of 2 Ω·cm.

Production Example 3 of Electroconductive Particles

Electroconductive particles P3 were obtained in the same manner as in Production Example 2 of electroconductive particles, except that the amount of phosphorus pentoxide was changed to 8 g. The electroconductive particles P3 were found to have the volume average particle diameter of 0.30 μm, the dope ratio of 0.100, and the powder specific resistivity of 21 Ω·cm.

Production Example 4 of Electroconductive Particles

Electroconductive particles P4 were obtained in the same manner as in Production Example 2 of electroconductive particles, except that the amount of phosphorus pentoxide was changed to 220 g. The electroconductive particles P4 were found to have the volume average particle diameter of 0.70 μm, the dope ratio of 0.100, and the powder specific resistivity of 2 Ω·cm.

Production Example 5 of Electroconductive Particles

Electroconductive particles P5 were obtained in the same manner as in Production Example 1 of electroconductive particles, except that 180 g of stannic chloride and 1.9 g of phosphorus pentoxide were added dropwise for 3 hour 30 min. The electroconductive particles P5 were found to have the volume average particle diameter of 0.35 μm, the dope ratio of 0.010, and the powder specific resistivity of 22 Ω·cm.

Production Example 6 of Electroconductive Particles

Electroconductive particles P6 were obtained in the same manner as in Production Example 1 of electroconductive particles, except that 1,700 g of stannic chloride and 180 g of phosphorus pentoxide were added dropwise for 34 hours. The electroconductive particles P6 were found to have the volume average particle diameter of 0.65 the dope ratio of 0.100, and the powder specific resistivity of 2 Ω·cm.

Production Example 7 of Electroconductive Particles

Electroconductive particles P7 were obtained in the same manner as in Production Example 1 of electroconductive particles, except that 720 g of stannic chloride and 75 g of phosphorus pentoxide were added dropwise for 14 hour 30 min. The electroconductive particles P7 were found to have the volume average particle diameter of 0.50 μm, the dope ratio of 0.010, and the powder specific resistivity of 20 Ω·cm.

Production Example 8 of Electroconductive Particles

Electroconductive particles P8 were obtained in the same manner as in Production Example 6 of electroconductive particles, except that the amount of phosphorus pentoxide was changed to 17 g. The electroconductive particles P8 were found to have the volume average particle diameter of 0.65 μm, the dope ratio of 0.010, and the powder specific resistivity of 16 Ω·cm.

Production Example 9 of Electroconductive Particles

Electroconductive particles P9 were obtained in the same manner as in Production Example 7 of electroconductive particles, except that the amount of phosphorus pentoxide was changed to 38 g. The electroconductive particles P9 were found to have the volume average particle diameter of 0.50 μm, the dope ratio of 0.050, and the powder specific resistivity of 10 Ω·cm.

Production Example 10 of Electroconductive Particles

Electroconductive particles P10 were obtained in the same manner as in Production Example 5 of electroconductive particles, except that the amount of phosphorus pentoxide was changed to 19 g. The electroconductive particles P10 were found to have the volume average particle diameter of 0.35 μm, the dope ratio of 0.100, and the powder specific resistivity of 6 Ω·cm.

Production Example 11 of Electroconductive Particles

Electroconductive particles P11 were obtained in the same manner as in Production Example 7 of electroconductive particles, except that the amount of phosphorus pentoxide was changed to 75 g. The electroconductive particles P11 were found to have the volume average particle diameter of 0.50 μm, the dope ratio of 0.100, and the powder specific resistivity of 5 Ω·cm.

Production Example 12 of Electroconductive Particles

Electroconductive particles P12 were obtained in the same manner as in Production Example 1 of electroconductive particles, except that 0.6 g of sodium tungstate was used instead of phosphorus pentoxide. The electroconductive particles P12 were found to have the volume average particle diameter of 0.30 μm, the dope ratio of 0.010, and the powder specific resistivity of 21 Ω·cm.

Production Example 13 of Electroconductive Particles

Electroconductive particles P13 were obtained in the same manner as in Production Example 2 of electroconductive particles, except that 16 g of sodium tungstate was used instead of phosphorus pentoxide. The electroconductive particles P13 were found to have the volume average particle diameter of 0.70 μm, the dope ratio of 0.100, and the powder specific resistivity of 13 Ω·cm.

Production Example 14 of Electroconductive Particles

Electroconductive particles P14 were obtained in the same manner as in Production Example 3 of electroconductive particles, except that 5.6 g of sodium tungstate was used instead of phosphorus pentoxide. The electroconductive particles P14 were found to have the volume average particle diameter of 0.30 μm, the dope ratio of 0.100, and the powder specific resistivity of 7 Ω·cm.

Production Example 15 of Electroconductive Particles

Electroconductive particles P15 were obtained in the same manner as in Production Example 4 of electroconductive particles, except that 155 g of sodium tungstate was used instead of phosphorus pentoxide. The electroconductive particles P15 were found to have the volume average particle diameter of 0.70 μm, the dope ratio of 0.100, and the powder specific resistivity of 2 Ω·cm.

Production Example 16 of Electroconductive Particles

Electroconductive particles P16 were obtained in the same manner as in Production Example 5 of electroconductive particles, except that 180 g of sodium tungstate was used instead of phosphorus pentoxide. The electroconductive particles P16 were found to have the volume average particle diameter of 0.35 μm, the dope ratio of 0.010, and the powder specific resistivity of 21 Ω·cm.

Production Example 17 of Electroconductive Particles

Electroconductive particles P17 were obtained in the same manner as in Production Example 6 of electroconductive particles, except that 124 g of sodium tungstate was used instead of phosphorus pentoxide. The electroconductive particles P17 were found to have the volume average particle diameter of 0.65 μm, the dope ratio of 0.100, and the powder specific resistivity of 2 Ω·cm.

Production Example 18 of Electroconductive Particles

Electroconductive particles P18 were obtained in the same manner as in Production Example 7 of electroconductive particles, except that 5.5 g of sodium tungstate was used instead of phosphorus pentoxide. The electroconductive particles P18 were found to have the volume average particle diameter of 0.50 μm, the dope ratio of 0.010, and the powder specific resistivity of 19 Ω·cm.

Production Example 19 of Electroconductive Particles

Electroconductive particles P19 were obtained in the same manner as in Production Example 8 of electroconductive particles, except that 12 g of sodium tungstate was used instead of phosphorus pentoxide. The electroconductive particles P19 were found to have the volume average particle diameter of 0.65 μm, the dope ratio of 0.010, and the powder specific resistivity of 15 Ω·cm.

Production Example 20 of Electroconductive Particles

Electroconductive particles P20 were obtained in the same manner as in Production Example 9 of electroconductive particles, except that 2.8 g of sodium tungstate was used instead of phosphorus pentoxide. The electroconductive particles P20 were found to have the volume average particle diameter of 0.50 the dope ratio of 0.050, and the powder specific resistivity of 8 Ω·cm.

Production Example 21 of Electroconductive Particles

Electroconductive particles P21 were obtained in the same manner as in Production Example 10 of electroconductive particles, except that 1.3 g of sodium tungstate was used instead of phosphorus pentoxide. The electroconductive particles P21 were found to have the volume average particle diameter of 0.35 μm, the dope ratio of 0.100, and the powder specific resistivity of 5 Ω·cm.

Production Example 22 of Electroconductive Particles

Electroconductive particles P22 were obtained in the same manner as in Production Example 11 of electroconductive particles, except that 2.8 g of sodium tungstate was used instead of phosphorus pentoxide. The electroconductive particles P22 were found to have the volume average particle diameter of 0.50 μm, the dope ratio of 0.100, and the powder specific resistivity of 3 Ω·cm.

Production Example 23 of Electroconductive Particles

Electroconductive particles P23 were obtained in the same manner as in Production Example 9 of electroconductive particles, except that titanium dioxide (product of Titan Kogyo, Ltd., KR-310) was used instead of aluminium oxide. The electroconductive particles P23 were found to have the volume average particle diameter of 0.50 μm, the dope ratio of 0.050, and the powder specific resistivity of 9 Ω·cm.

Production Example 24 of Electroconductive Particles

Electroconductive particles P24 were obtained in the same manner as in Production Example 9 of electroconductive particles, except that barium sulfate (B-50, product of Sakai Chemical Industry Co. Ltd.) was used instead of aluminium oxide. The electroconductive particles P24 were found to have the volume average particle diameter of 0.50 μm, the dope ratio of 0.050, and the powder specific resistivity of 10 Ω·cm.

Production Example 25 of Electroconductive Particles

The electroconductive particles P9 obtained in Production Example 9 of electroconductive particles were subjected to a heat treatment at 500° C. for 1.5 hours under nitrogen gas flow (1 L/min), followed by pulverizing. To the resultant pulverized product, was added 4% by mass of vinyl tetraethoxy silane while stirring in HENSCHEL MIXER which had been warmed to 70° C., followed by heating at 100° C. for 1 hour to thereby obtain electroconductive particles P25. The electroconductive particles P25 were found to have the volume average particle diameter of 0.50 μm, the dope ratio of 0.050, and the powder specific resistivity of 10 Ω·cm.

Production Comparative Example 1 of Electroconductive Particles

Electroconductive particles P1' were obtained in the same manner as in Production Example 7 of electroconductive particles, except that the amount of phosphorus pentoxide was changed to 7 g. The electroconductive particles P1' were found to have the volume average particle diameter of 0.50 μm, the dope ratio of 0.009, and the powder specific resistivity of 30 Ω·cm.

Production Comparative Example 2 of Electroconductive Particles

Electroconductive particles P2' were obtained in the same manner as in Production Example 7 of electroconductive particles, except that the amount of phosphorus pentoxide was changed to 83 g. The electroconductive particles P2' were found to have the volume average particle diameter of 0.50 μm, the dope ratio of 0.110, and the powder specific resistivity of 4 Ω·cm.

Production Comparative Example 3 of Electroconductive Particles

Electroconductive particles P3' were obtained in the same manner as in Production Example 18 of electroconductive particles, except that the amount of sodium tungstate was changed to 4.5 g. The electroconductive particles P3' were found to have the volume average particle diameter of 0.50 μm, the dope ratio of 0.009, and the powder specific resistivity of 28 Ω·cm.

Production Comparative Example 4 of Electroconductive Particles

Electroconductive particles P4' were obtained in the same manner as in Production Example 18 of electroconductive particles, except that the amount of sodium tungstate was changed to 58 g. The electroconductive particles P4' were found to have the volume average particle diameter of 0.50 μm, the dope ratio of 0.110, and the powder specific resistivity of 3 Ω·cm.

Synthetic Example 1 of Resin

A flask equipped with a stirrer was charged with 300 g of toluene and heated to 90° C. under nitrogen gas flow. To the flask, a mixture of 84.4 g (200 mmol) of 3-methacryloxypropyl tris(trimethylsiloxy)silane represented by $CH_2{=}CMe\text{-}COO{-}C_3H_6{-}Si(OSiMe_3)_3$ (where Me denotes methyl group) (SILAPLANE TM-0701 T, product of Chisso Corporation), 39 g (150 mmol) of 3-methacryloxypropylmethyldiethoxysilane, 65.0 g (650 mmol) of methyl methacrylate, and 0.58 g (3 mmol) of 2,2'-azobis-2-methylbutylonitrile was added dropwise for 1 hour.

After completion of dropwise addition, a solution of 0.06 g (0.3 mmol) of 2,2'-azobis-2-methylbutylonitrole in 15 g of toluene was added to the flask (the total amount of 2,2'-azobis-2-methylbutylonitrole was 0.64 g, i.e., 3.3 mmol), followed by mixing for 3 hours at 90° C. to 100° C., and allowing to radical-copolymerize to thereby obtain a methacrylic copolymer R1.

Production Example 1 of Carrier

| <Composition of coating layer> | |
|---|---|
| Acrylic resin solution (solid content: 50% by mass) | 51.3 parts by mass |
| Guanamine solution (solid content: 70% by mass) | 14.6 parts by mass |
| Titanium catalyst [solid content: 60% by mass (TC-750, product of Matsumoto Fine Chemical Co., Ltd.)] | 4 parts by mass |
| Silicone resin solution [solid content: 20% by mass (SR2410, product of Dow Corning Toray Co., Ltd.)] | 648 parts by mass |
| Amino silane [solid content: 100% by mass (SH6020, product of Dow Corning Toray Co., Ltd.)] | 3.2 parts by mass |
| Electroconductive particles P1 | 110 parts by mass |
| Toluene | 1,000 parts by mass |

The above materials of coating layer were dispersed with a homomixer for 10 min to thereby a coating layer-forming solution containing the acrylic resin and the silicone resin. The coating layer-forming solution is applied to the surface of the core particles C1 (5,000 parts by mass) so as to have a thickness of 0.30 μm using SPIRA COTA (product of OKADA SEIKO CO., LTD.) at an inside temperature of 55° C., and then dried to thereby obtained a carrier. The resultant carrier was fired by leaving in an electric furnace at 200° C. for 1 hour.

After cooling, a bulk of ferrite powder was sieved with a sieve having an opening of 63 μm to thereby obtain carrier 1. The carrier 1 was found to have the volume average particle diameter of 36 μm and the volume resistivity of 11 Log Ωcm.

The volume average particle diameter was measured in water using MICROTRAC particle size analyzer HRA9320-X100 (product of Nikkiso Co., Ltd.) with the following settings: refractive index of sample: 2.42; refractive index of solvent: 1.33; and concentration: about 0.06.

The volume resistivity of the carrier was measured using a measuring cell illustrated in FIG. 1 as follows. The measuring cell was comprised of a fluoro-resin container 2 in which electrodes 1*a* and 1*b* each having the surface area of 2.5 cm×4 cm were placed at a distance of 0.2 cm apart from each other. The measuring cell was filled with a carrier 3 and tapped from a height of 1 cm for 10 times at a tapping speed of 30 times/min. Thereafter, a direct current voltage of 1,000 V was applied to between the electrodes 1*a* and 1*b* for 30 seconds to measure the resistivity r[Ω] by a high resistance meter 4329A (product of Agilent Technologies, Inc.). The volume resistivity [Ω·cm] of the carrier was calculated from the following Calculation formula (2):

$$r\times(2.5\times4)/0.2 \qquad \text{Calculation formula (2)}$$

Production Example 2 of Carrier

Carrier 2 was obtained in the same manner as in Production Example 1 of carrier, except that 110 parts by mass of the electroconductive particles P1 were changed to 100 parts by mass of electroconductive particles P2. The carrier 2 was found to have the volume average particle diameter of 36 μm and the volume resistivity of 12 Log Ωcm.

Production Example 3 of Carrier

Carrier 3 was obtained in the same manner as in Production Example 1 of carrier, except that 110 parts by mass of the electroconductive particles P1 were changed to 100 parts by mass of electroconductive particles P3. The carrier 3 was found to have the volume average particle diameter of 36 μm and the volume resistivity of 12 Log Ωcm.

Production Example 4 of Carrier

Carrier 4 was obtained in the same manner as in Production Example 1 of carrier, except that 110 parts by mass of the electroconductive particles P1 were changed to 100 parts by mass of electroconductive particles P4. The carrier 4 was found to have the volume average particle diameter of 36 μm and the volume resistivity of 11 Log Ωcm.

Production Example 5 of Carrier

Carrier 5 was obtained in the same manner as in Production Example 1 of carrier, except that 110 parts by mass of the electroconductive particles P1 were changed to 100 parts by mass of electroconductive particles P5. The carrier 5 was found to have the volume average particle diameter of 36 μm and the volume resistivity of 11 Log Ωcm.

Production Example 6 of Carrier

Carrier 6 was obtained in the same manner as in Production Example 1 of carrier, except that 110 parts by mass of the electroconductive particles P1 were changed to 100 parts by mass of electroconductive particles P6. The carrier 6 was found to have the volume average particle diameter of 36 μm and the volume resistivity of 11 Log Ωcm.

Production Example 7 of Carrier

Carrier 7 was obtained in the same manner as in Production Example 1 of carrier, except that 110 parts by mass of the electroconductive particles P1 were changed to 100 parts by mass of electroconductive particles P7. The carrier 7 was found to have the volume average particle diameter of 36 μm and the volume resistivity of 11 Log Ωcm.

Production Example 8 of Carrier

Carrier 8 was obtained in the same manner as in Production Example 1 of carrier, except that 110 parts by mass of the electroconductive particles P1 were changed to 100 parts by mass of electroconductive particles P8. The carrier 8 was found to have the volume average particle diameter of 36 μm and the volume resistivity of 11 Log Ωcm.

Production Example 9 of Carrier

Carrier 9 was obtained in the same manner as in Production Example 1 of carrier, except that 110 parts by mass of the electroconductive particles P1 were changed to 100 parts by mass of electroconductive particles P9. The carrier 9 was found to have the volume average particle diameter of 36 μM and the volume resistivity of 11 Log Ωcm.

Production Example 10 of Carrier

Carrier 10 was obtained in the same manner as in Production Example 1 of carrier, except that 110 parts by mass of the electroconductive particles P1 were changed to 100 parts by mass of electroconductive particles P10. The carrier 10 was found to have the volume average particle diameter of 36 μm and the volume resistivity of 11 Log Ωcm.

Production Example 11 of Carrier

Carrier 11 was obtained in the same manner as in Production Example 1 of carrier, except that 110 parts by mass of the electroconductive particles P1 were changed to 100 parts by mass of electroconductive particles P11. The carrier 11 was found to have the volume average particle diameter of 36 μm and the volume resistivity of 11 Log Ωcm.

Production Example 12 of Carrier

Carrier 12 was obtained in the same manner as in Production Example 1 of carrier, except that 110 parts by mass of the electroconductive particles P1 were changed to 100 parts by mass of electroconductive particles P12. The carrier 12 was found to have the volume average particle diameter of 36 μm and the volume resistivity of 12 Log Ωcm.

Production Example 13 of Carrier

Carrier 13 was obtained in the same manner as in Production Example 1 of carrier, except that 110 parts by mass of the electroconductive particles P1 were changed to 100 parts by mass of electroconductive particles P13. The carrier 13 was found to have the volume average particle diameter of 36 μm and the volume resistivity of 11 Log Ωcm.

Production Example 14 of Carrier

Carrier 14 was obtained in the same manner as in Production Example 1 of carrier, except that 110 parts by mass of the electroconductive particles P1 were changed to 100 parts by mass of electroconductive particles P14. The carrier 14 was found to have the volume average particle diameter of 36 μM and the volume resistivity of 11 Log Ωcm.

Production Example 15 of Carrier

Carrier 15 was obtained in the same manner as in Production Example 1 of carrier, except that 110 parts by mass of the electroconductive particles P1 were changed to 100 parts by mass of electroconductive particles P15. The carrier 15 was found to have the volume average particle diameter of 36 μm and the volume resistivity of 11 Log Ωcm.

Production Example 16 of Carrier

Carrier 16 was obtained in the same manner as in Production Example 1 of carrier, except that 110 parts by mass of the electroconductive particles P1 were changed to 100 parts by mass of electroconductive particles P16. The carrier 16 was found to have the volume average particle diameter of 36 μm and the volume resistivity of 12 Log Ωcm.

Production Example 17 of Carrier

Carrier 17 was obtained in the same manner as in Production Example 1 of carrier, except that 110 parts by mass of the electroconductive particles P1 were changed to 100 parts by mass of electroconductive particles P17. The carrier 17 was found to have the volume average particle diameter of 36 μm and the volume resistivity of 12 Log Ωcm.

Production Example 18 of Carrier

Carrier 18 was obtained in the same manner as in Production Example 1 of carrier, except that 110 parts by mass of the electroconductive particles P1 were changed to 100 parts by mass of electroconductive particles P18. The carrier 18 was found to have the volume average particle diameter of 36 μm and the volume resistivity of 12 Log Ωcm.

Production Example 19 of Carrier

Carrier 19 was obtained in the same manner as in Production Example 1 of carrier, except that 110 parts by mass of the electroconductive particles P1 were changed to 100 parts by mass of electroconductive particles P19. The carrier 19 was found to have the volume average particle diameter of 36 μm and the volume resistivity of 12 Log Ωcm.

Production Example 20 of Carrier

Carrier 20 was obtained in the same manner as in Production Example 1 of carrier, except that 110 parts by mass of the electroconductive particles P1 were changed to 100 parts by mass of electroconductive particles P20. The carrier 20 was found to have the volume average particle diameter of 36 μm and the volume resistivity of 12 Log ΩCm.

Production Example 21 of Carrier

Carrier 21 was obtained in the same manner as in Production Example 1 of carrier, except that 110 parts by mass of the electroconductive particles P1 were changed to 100 parts by mass of electroconductive particles P21. The carrier 21 was found to have the volume average particle diameter of 36 μm and the volume resistivity of 12 Log Ωcm.

Production Example 22 of Carrier

Carrier 22 was obtained in the same manner as in Production Example 1 of carrier, except that 110 parts by mass of the electroconductive particles P1 were changed to 100 parts by mass of electroconductive particles P22. The carrier 22 was found to have the volume average particle diameter of 36 μm and the volume resistivity of 12 Log Ωcm.

Production Example 23 of Carrier

Carrier 23 was obtained in the same manner as in Production Example 1 of carrier, except that 110 parts by mass of the electroconductive particles P1 were changed to 100 parts by mass of electroconductive particles P23. The carrier 23 was found to have the volume average particle diameter of 36 μm and the volume resistivity of 11 Log Ωcm.

Production Example 24 of Carrier

Carrier 24 was obtained in the same manner as in Production Example 1 of carrier, except that 110 parts by mass of the electroconductive particles P1 were changed to 100 parts by mass of electroconductive particles P24. The carrier 24 was found to have the volume average particle diameter of 36 μm and the volume resistivity of 11 Log Ωcm.

Production Example 25 of Carrier

Carrier 25 was obtained in the same manner as in Production Example 1 of carrier, except that 110 parts by mass of the electroconductive particles P1 were changed to 100 parts by mass of electroconductive particles P25. The carrier 25 was found to have the volume average particle diameter of 36 μm and the volume resistivity of 11 Log Ωcm.

Production Example 26 of Carrier

| <Composition of coating layer> | |
|---|---|
| Methacrylic copolymer R1 (solid content: 20% by mass) | 780 parts by mass |
| Titanium catalyst [solid content: 60% by mass (TC-750, product of Matsumoto Fine Chemical Co., Ltd.)] | 4 parts by mass |
| Amino silane [solid content: 100% by mass (SH6020, product of Dow Corning Toray Co., Ltd.)] | 3.2 parts by mass |
| Electroconductive particles P9 | 100 parts by mass |
| Toluene | 1,000 parts by mass |

The above materials of coating layer were dispersed with a homomixer for 10 min to thereby a coating layer-forming solution. The coating layer-forming solution is applied to the surface of the core particles C1 (5,000 parts by mass) so as to have a thickness of 0.30 μm using SPIRA COTA (product of OKADA SEIKO CO., LTD.) at an inside temperature of 55° C., and then dried to thereby obtained a carrier. The resultant carrier was fired by leaving in an electric furnace at 200° C. for 1 hour. After cooling, a bulk of ferrite powder was sieved with a sieve having an opening of 63 μm to thereby obtain carrier 26. The carrier 26 was found to have the volume average particle diameter of 36 μm and the volume resistivity of 11 Log Ωcm.

Production Example 27 of Carrier

Carrier 27 was obtained in the same manner as in Production Example 1 of carrier, except that the core particles was changed to 5,000 parts by mass of C2. The carrier 27 was found to have the volume average particle diameter of 36 μm and the volume resistivity of 11 Log Ωcm.

Production Comparative Example 1 of Carrier

Carrier 1' was obtained in the same manner as in Production Example 1 of carrier, except that the electroconductive particles were changed to 100 parts by mass of electroconductive particles P1'. The carrier 1' was found to have the volume average particle diameter of 36 μm and the volume resistivity of 13 Log Ωcm.

Production Comparative Example 2 of Carrier

Carrier 2' was obtained in the same manner as in Production Example 1 of carrier, except that the electroconductive particles were changed to 100 parts by mass of electroconductive particles P2'. The carrier 2' was found to have the volume average particle diameter of 36 μm and the volume resistivity of 11 Log Ωcm.

Production Comparative Example 3 of Carrier

Carrier 3' was obtained in the same manner as in Production Example 1 of carrier, except that the electroconductive particles were changed to 100 parts by mass of electroconductive particles P3'. The carrier 3' was found to have the volume average particle diameter of 36 μm and the volume resistivity of 13 Log Ωcm.

Production Comparative Example 4 of Carrier

Carrier 4' was obtained in the same manner as in Production Example 1 of carrier, except that the electroconductive particles were changed to 100 parts by mass of electroconductive particles P4'. The carrier 4' was found to have the volume average particle diameter of 36 μm and the volume resistivity of 11 Log Ωcm.

Properties of the obtained carriers are shown in Tables 1-1 and 1-2.

TABLE 1-1

| | Developer No. | Carrier No. | Volume average particle diameter of carrier (μm) | Volume resistivity of carrier (LogΩcm) | Electro-conductive particles | Dope ratio |
|---|---|---|---|---|---|---|
| Ex. 1 | 1 | 1 | 36 | 12 | P1 | 0.010 |
| Ex. 2 | 2 | 2 | 36 | 11 | P2 | 0.010 |
| Ex. 3 | 3 | 3 | 36 | 12 | P3 | 0.100 |
| Ex. 4 | 4 | 4 | 36 | 11 | P4 | 0.100 |
| Ex. 5 | 5 | 5 | 36 | 12 | P5 | 0.010 |
| Ex. 6 | 6 | 6 | 36 | 11 | P6 | 0.100 |
| Ex. 7 | 7 | 7 | 36 | 11 | P7 | 0.010 |
| Ex. 8 | 8 | 8 | 36 | 11 | P8 | 0.010 |
| Ex. 9 | 9 | 9 | 36 | 11 | P9 | 0.050 |
| Ex. 10 | 10 | 10 | 36 | 11 | P10 | 0.100 |
| Ex. 11 | 11 | 11 | 36 | 11 | P11 | 0.100 |
| Ex. 12 | 12 | 12 | 36 | 12 | P12 | 0.010 |
| Ex. 13 | 13 | 13 | 36 | 11 | P13 | 0.010 |
| Ex. 14 | 14 | 14 | 36 | 11 | P14 | 0.100 |
| Ex. 15 | 15 | 15 | 36 | 11 | P15 | 0.100 |
| Ex. 16 | 16 | 16 | 36 | 12 | P16 | 0.010 |
| Ex. 17 | 17 | 17 | 36 | 11 | P17 | 0.100 |
| Ex. 18 | 18 | 18 | 36 | 11 | P18 | 0.010 |
| Ex. 19 | 19 | 19 | 36 | 11 | P19 | 0.010 |
| Ex. 20 | 20 | 20 | 36 | 11 | P20 | 0.050 |
| Ex. 21 | 21 | 21 | 36 | 11 | P21 | 0.100 |
| Ex. 22 | 22 | 22 | 36 | 11 | P22 | 0.100 |
| Ex. 23 | 23 | 23 | 36 | 11 | P23 | 0.050 |
| Ex. 24 | 24 | 24 | 36 | 11 | P24 | 0.050 |
| Ex. 25 | 25 | 25 | 36 | 11 | P25 | 0.050 |
| Ex. 26 | 26 | 26 | 36 | 11 | P9 | 0.050 |
| Ex. 27 | 27 | 27 | 36 | 11 | P9 | 0.050 |
| Comp. Ex. 1 | 1' | 1' | 36 | 13 | P1' | 0.009 |
| Comp. Ex. 2 | 2' | 2' | 36 | 11 | P2' | 0.11 |
| Comp. Ex. 3 | 3' | 3' | 36 | 13 | P3' | 0.009 |
| Comp. Ex. 4 | 4' | 4' | 36 | 11 | P4' | 0.11 |

TABLE 1-2

| | Particle diameter of electro-conductive particles (μm) | Particle diameter of base particles (μm) | Particle diameter ratio of base particles/ electro conductive particles | Powder specific resistivity (Ω · cm) | Core particles |
|---|---|---|---|---|---|
| Ex. 1 | 0.3 | 0.25 | 1.2 | 24 | C1 |
| Ex. 2 | 0.70 | 0.25 | 2.8 | 2 | C1 |
| Ex. 3 | 0.30 | 0.25 | 1.2 | 21 | C1 |
| Ex. 4 | 0.70 | 0.25 | 2.8 | 2 | C1 |
| Ex. 5 | 0.35 | 0.25 | 1.4 | 22 | C1 |
| Ex. 6 | 0.65 | 0.25 | 2.6 | 2 | C1 |
| Ex. 7 | 0.50 | 0.25 | 2.0 | 20 | C1 |
| Ex. 8 | 0.65 | 0.25 | 2.6 | 16 | C1 |
| Ex. 9 | 0.50 | 0.25 | 2.0 | 10 | C1 |
| Ex. 10 | 0.35 | 0.25 | 1.4 | 6 | C1 |
| Ex. 11 | 0.50 | 0.25 | 2.0 | 5 | C1 |
| Ex. 12 | 0.3 | 0.25 | 1.2 | 21 | C1 |
| Ex. 13 | 0.70 | 0.25 | 2.8 | 13 | C1 |
| Ex. 14 | 0.40 | 0.25 | 1.6 | 7 | C1 |
| Ex. 15 | 0.70 | 0.25 | 2.8 | 2 | C1 |
| Ex. 16 | 0.35 | 0.25 | 1.4 | 21 | C1 |
| Ex. 17 | 0.65 | 0.25 | 2.6 | 2 | C1 |
| Ex. 18 | 0.50 | 0.25 | 2.0 | 19 | C1 |
| Ex. 19 | 0.65 | 0.25 | 2.6 | 15 | C1 |
| Ex. 20 | 0.50 | 0.25 | 2.0 | 8 | C1 |
| Ex. 21 | 0.35 | 0.25 | 1.4 | 5 | C1 |
| Ex. 22 | 0.50 | 0.25 | 2.0 | 3 | C1 |
| Ex. 23 | 0.50 | 0.25 | 2.0 | 9 | C1 |
| Ex. 24 | 0.50 | 0.25 | 2.0 | 10 | C1 |
| Ex. 25 | 0.50 | 0.25 | 2.0 | 10 | C1 |
| Ex. 26 | 0.50 | 0.25 | 2.0 | 10 | C1 |
| Ex. 27 | 0.50 | 0.25 | 2.0 | 10 | C2 |
| Comp. Ex. 1 | 0.50 | 0.25 | 2.0 | 30 | C1 |
| Comp. Ex. 2 | 0.50 | 0.25 | 2.0 | 4 | C1 |
| Comp. Ex. 3 | 0.50 | 0.25 | 2.0 | 28 | C1 |
| Comp. Ex. 4 | 0.50 | 0.25 | 2.0 | 3 | C1 |

Production Example of Toner

Synthetic Example of Polyester Resin A

A reaction vessel equipped with a thermometer, a stirrer, a condenser, and a nitrogen inlet pipe was charged with bisphenol A-PO adduct (hydroxyl value: 320 mgKOH/g) (443 parts by mass), diethylene glycol (135 parts by mass), terephthalic acid (422 parts by mass), and dibutyltin oxide (2.5 parts by mass), followed by allowing to react at 200° C. until the acid value was 10 mgKOH/g to thereby obtain [polyester resin A]. The [polyester resin A] was found to have the glass transition temperature (Tg) of 63° C. and the peak number average molecular weight of 6,000.

Synthetic Example of Polyester Resin B

A reaction vessel equipped with a thermometer, a stirrer, a condenser, and a nitrogen inlet pipe was charged with bisphenol A-PO adduct (hydroxyl value: 320 mgKOH/g) (443 parts by mass), diethylene glycol (135 parts by mass), terephthalic acid (422 parts by mass), and dibutyltin oxide (2.5 parts by mass), followed by allowing to react at 230° C. until the acid value was 7 mgKOH/g to thereby obtain [polyester resin B]. The [polyester resin B] was found to have the glass transition temperature (Tg) of 65° C. and the peak number average molecular weight of 16,000.

[Production of Toner Base Particles 1]

| | |
|---|---|
| Polyester resin A | 40 parts by mass |
| Polyester resin B | 60 parts by mass |
| Carnauba wax | 1 part by mass |
| Carbon black (#44, product of Mitsubishi Chemical Corporation) | 15 parts by mass |

The above toner materials were mixed for 3 min at 1,500 rpm by HENSCHEL MIXER 20B (product of Nippon Coke & Engineering Co., Ltd.). The resultant mixture was kneaded by a single-screw kneader (compact type of BUSS-KO-KNEADER, product of Buss Corporation) with the following setting: the inlet temperature: 100° C.; the outlet temperature: 50° C.; and the feed rate: 2 kg/hr. Thus, [toner base particles A1] was obtained.

The [toner base particles A1] was then keaded, cooled by rolling, and pulverized by a pulverizer. The resultant particles were further pulverized into fine particles by I-type mill (IDS-2, product of Nippon Pneumatic Mfg. Co., Ltd.) using a flat collision plate with the following settings: the air pressure: 6.8 atm/cm$^2$; and the feed rate: 0.5 kg/hr. The resultant fine particles were classified by a classifier (132MP, product of Hosokawa Alpine AG.). Thus, [toner base particles 1] were obtained.

(External Addition Treatment)

To 100 parts by mass of the [toner base particles 1], was added 1.0 part by mass of a hydrophobic silica particles (R972, product of Nippon Aerosil Co., Ltd.), followed by mixing with HENSCHEL MIXER to thereby obtain a toner (hereinafter referred to as "toner 1").

[Production of Developers 1 to 27 and 1' to 4']

To each of the carriers 1 to 27 and 1' to 4' obtained in Production Examples of carrier (93 parts by mass), was added the toner 1 (volume average particle diameter: 7.2 μm) (7.0 parts by mass), followed by stirring for 20 min using a ball mill. Thus, developers 1 to 27 and 1' to 4' were prepared.

[Evaluation of Developer Properties]

The developers were subjected to image evaluation using a multifunction digital color copier-printer (RICOH PRO C901, product of Ricoh Company, Ltd.).

Specifically, the charge amount of carrier and the volume resistivity before and after printing of 1 million sheets at the image area occupancy of 20% were measured using the developers 1 to 27 and 1' to 4' and the toner 1, followed by calculating the decreasing rate of the charge amount and the changing rate of the volume resistivity therefrom.

Notably, the charge amount of carrier before printing (Q1) was measured as follows. The carriers 1 to 27 and 1' to 4' were mixed with the toner 1 in the mass ratio of 93:7, and then charged by friction to thereby a sample. The sample was subjected to a measurement using a blow off device (TB-200, product of Toshiba Chemical Corporation). The charge amount of carrier after printing of 1 million sheets (Q2) was measured in the same manner as in the above, except that the toner of each color contained in the developers after printing was removed using the blow off device. A targeted value of the decreasing rate of the charge amount is 10 (μC/g) or less.

The volume resistivity of carrier before printing (Log R1) was expressed as a common logarithmic value of the volume resistivity of carrier measured in the same manner as in the [volume resistivity]. The volume resistivity of carrier after printing of 1 million sheets (Log R2) was measured in the same manner as in the above, except that the toner of each color contained in the developers after printing was removed using the blow off device. A targeted value of the volume resistivity is less than 2.0 (Log Ωcm) as the absolute value. The evaluation results of the developers are shown in Tables 2-1 and 2-2.

TABLE 2-1

| | Developer No. | Q1 (−μC/g) | Q2 (−μC/g) | Q1 − Q2 (−μC/g) |
|---|---|---|---|---|
| Ex. 1 | 1 | 36 | 33 | 3 |
| Ex. 2 | 2 | 37 | 34 | 3 |
| Ex. 3 | 3 | 36 | 30 | 6 |
| Ex. 4 | 4 | 35 | 30 | 5 |
| Ex. 5 | 5 | 36 | 33 | 3 |
| Ex. 6 | 6 | 40 | 33 | 7 |
| Ex. 7 | 7 | 32 | 28 | 4 |
| Ex. 8 | 8 | 36 | 33 | 3 |
| Ex. 9 | 9 | 40 | 39 | 1 |
| Ex. 10 | 10 | 36 | 30 | 6 |
| Ex. 11 | 11 | 39 | 32 | 7 |
| Ex. 12 | 12 | 35 | 31 | 4 |
| Ex. 13 | 13 | 36 | 33 | 3 |
| Ex. 14 | 14 | 38 | 31 | 7 |
| Ex. 15 | 15 | 38 | 32 | 6 |
| Ex. 16 | 16 | 36 | 32 | 4 |
| Ex. 17 | 17 | 37 | 30 | 7 |
| Ex. 18 | 18 | 41 | 38 | 3 |
| Ex. 19 | 19 | 36 | 32 | 4 |
| Ex. 20 | 20 | 38 | 37 | 1 |
| Ex. 21 | 21 | 36 | 30 | 6 |
| Ex. 22 | 22 | 37 | 31 | 6 |
| Ex. 23 | 23 | 36 | 30 | 6 |
| Ex. 24 | 24 | 35 | 30 | 5 |
| Ex. 25 | 25 | 32 | 27 | 5 |
| Ex. 26 | 26 | 36 | 31 | 5 |
| Ex. 27 | 27 | 35 | 30 | 5 |
| Comp. Ex. 1 | 1' | 34 | 30 | 4 |
| Comp. Ex. 2 | 2' | 38 | 27 | 11 |
| Comp. Ex. 3 | 3' | 40 | 37 | 3 |
| Comp. Ex. 4 | 4' | 38 | 27 | 11 |

TABLE 2-2

| | LogR1 (Log Ω · cm) | LogR2 (Log Ω · cm) | LogRl − LogR2 (Log Ω · cm) |
|---|---|---|---|
| Ex. 1 | 12 | 10 | 2 |
| Ex. 2 | 11 | 9 | 2 |
| Ex. 3 | 12 | 10 | 2 |
| Ex. 4 | 11 | 9 | 2 |
| Ex. 5 | 12 | 10 | 2 |
| Ex. 6 | 11 | 9 | 2 |
| Ex. 7 | 11 | 9 | 2 |
| Ex. 8 | 11 | 9 | 2 |
| Ex. 9 | 11 | 11 | 0 |
| Ex. 10 | 11 | 9 | 2 |
| Ex. 11 | 11 | 9 | 2 |

TABLE 2-2-continued

| | LogR1 (Log Ω · cm) | LogR2 (Log Ω · cm) | LogR1 − LogR2 (Log Ω · cm) |
|---|---|---|---|
| Ex. 12 | 12 | 9 | 3 |
| Ex. 13 | 11 | 9 | 2 |
| Ex. 14 | 11 | 9 | 2 |
| Ex. 15 | 11 | 9 | 2 |
| Ex. 16 | 12 | 10 | 2 |
| Ex. 17 | 11 | 9 | 2 |
| Ex. 18 | 11 | 9 | 2 |
| Ex. 19 | 11 | 9 | 2 |
| Ex. 20 | 11 | 11 | 0 |
| Ex. 21 | 11 | 9 | 2 |
| Ex. 22 | 11 | 9 | 2 |
| Ex. 23 | 11 | 9 | 2 |
| Ex. 24 | 11 | 9 | 2 |
| Ex. 25 | 11 | 9 | 2 |
| Ex. 26 | 11 | 9 | 2 |
| Ex. 27 | 11 | 9 | 2 |
| Comp. Ex. 1 | 13 | 7 | 6 |
| Comp. Ex. 2 | 11 | 9 | 2 |
| Comp. Ex. 3 | 13 | 6 | 7 |
| Comp. Ex. 4 | 11 | 9 | 2 |

<Evaluation Using Real Machine>

Image quality was evaluated using a multifunction digital color copier-printer (RICOH PRO C901, product of Ricoh Company, Ltd.) under the following developing conditions.

Developing gap (between photoconductor and developing sleeve): 0.3 mm

Doctor gap (between developing sleeve and doctor blade): 0.65 mm

Linear speed of photoconductor: 440 mm/sec (Linear speed of developing sleeve)/(Linear speed of photoconductor): 1.80

Writing density: 600 dpi

Charged potential (Vd): −600 V

Potential after exposing in image portion (solid portion): −100 V

Developing bias: DC −500 V/alternating current bias component: 2 kHz, −100 V to −900 V, 50% duty <<Image Density in Solid Portion>>

The average image density was calculated from image densities at the centers of 5 solid portions (30 mm×30 mm) (Note 1) measured by X-Rite 938 spectral densitometer under the above described developing conditions.

Note 1: Portions in which developing potential corresponds to 400 V=(Potential of exposed portions−Developing bias DC)=−100 V−(−500 V)

The difference between the initial ID and the ID after printing of 1 million sheets was evaluated according to the following criteria.

[Evaluation Criteria]

A (Very good): 0 or more but less than 0.2

B (Good): 0.2 or more but less than 0.3

C (Usable): 0.3 or more but less than 0.4

D (Not usable): 0.4 or more

<<Image Density in Highlight Portion>>

The average image density was calculated from image densities at the centers of 5 highlight portions (30 mm×30 mm) (Note 2) measured by X-Rite 938 spectral densitometer under the above described developing conditions.

Note 2: Portions in which developing potential corresponds to 150 V=(Potential of highlight portions−Developing bias DC)=−350 V−(−500 V)

The difference between the initial ID and the ID after printing of 1 million sheets was evaluated according to the following criteria.

[Evaluation Criteria]

A (Very good): 0 or more but less than 0.2

B (Good): 0.2 or more but less than 0.3

C (Usable): 0.3 or more but less than 0.4

D (Not usable): 0.4 or more

<<Granularity>>

Granularity (brightness range: 50 to 80) defined according to the following equation was determined and ranked by the following criteria.

$$\text{Granularity}=\exp(aL+b)\int(WS(f))^{1/2}\cdot VTF(f)df$$

where L denotes the average brightness, f denotes the spatial frequency (cycle/mm), WS(f) denotes the power spectrum of brightness variation, VTF(f) denotes the spatial frequency characteristic of vision, and each of a and b denotes a coefficient.

A (Very good): 0 or more but less than 0.2

B (Good): 0.2 or more but less than 0.3

C (Usable): 0.3 or more but less than 0.4

D (Not usable): 0.4 or more

<<Carrier Adhesion in Solid Portion>>

Carrier adhesion causes a deficiency on a photoconductor drum and a fixing roller, and deteriorates image quality. Even when the carrier adhesion occurs on a photoconductor, only some of the carrier particles adhered is transferred onto paper. Thus, the carrier adhesion was evaluated as follows.

The number of carrier particles adhered onto a solid image (30 mm×30 mm) formed by RICOH PRO C901 under the above-described developing conditions (Charged potential (Vd): −600 V; Potential after exposing in image portion (solid portion): −100 V; Developing bias: DC −500 V) was counted on a photocunductor. Based on the counted number, carrier adhesion in solid portion after printing of 1 million sheets was evaluated according to the following criteria.

A (Very good)

B (Good)

C (Usable)

D (Not usable)

TABLE 3

| | Developer No. | Image density in solid portion | Image density in highlight portion | Granularity | Carrier adhesion in solid portion |
|---|---|---|---|---|---|
| Ex. 1 | 1 | B | C | A | C |
| Ex. 2 | 2 | B | C | A | B |
| Ex. 3 | 3 | C | C | A | B |
| Ex. 4 | 4 | C | C | A | C |
| Ex. 5 | 5 | B | C | A | C |
| Ex. 6 | 6 | C | C | A | C |
| Ex. 7 | 7 | B | B | A | B |
| Ex. 8 | 8 | B | B | A | B |
| Ex. 9 | 9 | A | A | A | A |
| Ex. 10 | 10 | C | B | A | B |
| Ex. 11 | 11 | C | B | A | B |
| Ex. 12 | 12 | B | C | A | C |
| Ex. 13 | 13 | B | C | A | B |
| Ex. 14 | 14 | C | C | A | B |
| Ex. 15 | 15 | C | C | A | C |
| Ex. 16 | 16 | B | C | A | C |
| Ex. 17 | 17 | C | C | A | C |
| Ex. 18 | 18 | B | B | A | B |
| Ex. 19 | 19 | B | B | A | B |
| Ex. 20 | 20 | A | A | A | A |
| Ex. 21 | 21 | C | B | A | B |
| Ex. 22 | 22 | C | B | A | B |
| Ex. 23 | 23 | B | B | A | B |

TABLE 3-continued

| | Developer No. | Image density in solid portion | Image density in highlight portion | Granularity | Carrier adhesion in solid portion |
|---|---|---|---|---|---|
| Ex. 24 | 24 | B | B | A | B |
| Ex. 25 | 25 | B | B | A | B |
| Ex. 26 | 26 | B | B | A | B |
| Ex. 27 | 27 | B | B | A | B |
| Comp. Ex. 1 | 1' | B | B | A | D |
| Comp. Ex. 2 | 2' | D | D | A | B |
| Comp. Ex. 3 | 3' | B | B | A | D |
| Comp. Ex. 4 | 4' | D | D | A | B |

Embodiments of the present invention are as follows:

<1> A carrier including:

magnetic core particles; and a coating layer on a surface of each of the magnetic core particles, wherein the coating layer contains electroconductive particles;

wherein the electroconductive particles are electroconductive particles in which white inorganic pigments are coated with phosphorus-doped tin or tungsten-doped tin; and wherein a dope ratio of phosphorus or tungsten to tin in the phosphorus-doped tin or the tungsten-doped tin is 0.010 to 0.100.

<2> The carrier according to <1>, wherein a particle diameter of the white inorganic pigments in the electroconductive particles R1 (μm) and a particle diameter of the electroconductive particles R2 (μm) meet the following expression: $1.4 \leq R2/R1 \leq 2.6$.

<3> The carrier according to <1> or <2>, wherein the white inorganic pigments are aluminium oxide, titanium dioxide, or barium sulfate.

<4> The carrier according to any one of <1> to <3>, wherein a powder specific resistivity of the electroconductive particles is 3 Ω·cm to 20 Ω·cm.

<5> The carrier according to any one of <1> to <4>, wherein a volume average particle diameter of the electroconductive particles is 0.35 μm to 0.65 μm.

<6> The carrier according to any one of <1> to <5>, wherein a volume average particle diameter of the carrier is 32 μm to 40 μm.

<7> The carrier according to any one of <1> to <6>, wherein a volume resistivity of the carrier is 8 Log Ω·cm to 14 Log Ω·cm.

<8> A two-component developer including:

the carrier according to any one of <1> to <7>; and a toner.

<9> The two-component developer according to <8>, wherein the toner is a color-toner.

<10> A supplemental developer including:

a carrier; and a toner, wherein 2 parts by mass to 50 parts by mass of the toner is contained relative to 1 part by mass of the carrier, and wherein the carrier is the carrier according to any one of <1> to <7>.

<11> An image forming apparatus including:

an electrostatic latent image bearing member;

an electrostatic latent image forming unit configured to form an electrostatic latent image on the electrostatic latent image bearing member;

a developing unit configured to develop the electrostatic latent image with a developer to thereby form a visible image;

a transfer unit configured to transfer the visible image to a recording medium; and a fixing unit configured to fix the visible image transferred to the recording medium, wherein the developer is the two-component developer according to <8> or <9> or the supplemental developer according to <10>.

<12> A process cartridge including:

an electrostatic latent image bearing member; and a developing unit configured to develop with a developer an electrostatic latent image formed on the electrostatic latent image bearing member to thereby form a visible image, wherein the developer is the two-component developer according to <8> or <9> or the supplemental developer according to <10>.

<13> An image forming method including:

forming an electrostatic latent image on an electrostatic latent image bearing member;

developing the electrostatic latent image with a developer to thereby form a visible image;

transferring the visible image to a recording medium; and fixing the visible image transferred to the recording medium, wherein the developer is the two-component developer according to <8> or <9> or the supplemental developer according to <10>.

REFERENCE SIGNS LIST

1*a*: Electrode
1*b*: Electrode
2: Fluoro-resin
3: Carrier
10: Process cartridge
11: Photoconductor
12: Charging unit
13: Developing unit
14: Cleaning unit

The invention claimed is:

1. A carrier comprising:

magnetic core particles; and a coating layer on a surface of each of the magnetic core particles, wherein the coating layer comprises electroconductive particles, wherein the electroconductive particles are electroconductive particles in which a white inorganic pigment is coated with phosphorus-doped tin or tungsten-doped tin, wherein a dope ratio of phosphorus or tungsten to tin in the phosphorus-doped tin or the tungsten-doped tin is 0.010 to 0.100, and wherein a particle diameter of the white inorganic pigment in the electroconductive particles R1 (μm) and a particle diameter of the electroconductive particles R2 (μm) satisfy the following expression: $1.4 \leq R2/R1 \leq 2.6$.

2. The carrier according to claim 1, wherein the white inorganic pigment is aluminum oxide, titanium dioxide, or barium sulfate.

3. The carrier according to claim 1, wherein a powder specific resistivity of the electroconductive particles is 3 Ω·cm to 20 Ω·cm.

4. The carrier according to claim 1, wherein a volume average particle diameter of the electroconductive particles is 0.35 μm to 0.65 μm.

5. The carrier according to claim 1, wherein a volume average particle diameter of the carrier is 32 μm to 40 μm.

6. The carrier according to claim 1, wherein a volume resistivity of the carrier is 8 Log Ω·cm to 14 Log Ω·cm.

7. A two-component developer comprising:

the carrier according to claim 1; and a toner.

8. The two-component developer according to claim 7, wherein the toner is a color-toner.

9. A supplemental developer comprising:

a carrier; and a toner, wherein 2 parts by mass to 50 parts by mass of the toner is contained relative to 1 part by mass of the carrier, and wherein the carrier is the carrier according to claim 1.

10. A process cartridge comprising:

a developer being the two-component developer according to claim 7;

an electrostatic latent image bearing member; and a developing unit configured to develop with a developer an electrostatic latent image formed on the electrostatic latent image bearing member to thereby form a visible image.

11. An image forming method comprising:

forming an electrostatic latent image on an electrostatic latent image bearing member;

developing the electrostatic latent image with a developer to thereby form a visible image;

transferring the visible image to a recording medium; and fixing the visible image transferred to the recording medium, wherein the developer is the two-component developer according to claim 7.

12. A process cartridge comprising:

a developer being the supplemental developer according to claim 9;

an electrostatic latent image bearing member; and a developing unit configured to develop with a developer an electrostatic latent image formed on the electrostatic latent image bearing member to thereby form a visible image.

13. An image forming method comprising:

forming an electrostatic latent image on an electrostatic latent image bearing member;

developing the electrostatic latent image with a developer to thereby form a visible image;

transferring the visible image to a recording medium; and fixing the visible image transferred to the recording medium, wherein the developer is the supplemental developer according to claim 9.

* * * * *